US007588639B2

(12) United States Patent
Iwasaki et al.

(10) Patent No.: US 7,588,639 B2
(45) **Date of Patent: *Sep. 15, 2009**

(54) LIQUID APPLYING APPARATUS AND INK JET PRINTING APPARATUS

(75) Inventors: Osamu Iwasaki, Tokyo (JP); Naoji Otsuka, Yokohama (JP); Yoshinori Nakagawa, Kawasaki (JP); Keisei Hakamata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/124,744

(22) Filed: May 21, 2008

(65) Prior Publication Data

US 2008/0223290 A1 Sep. 18, 2008

Related U.S. Application Data

(62) Division of application No. 11/052,062, filed on Feb. 8, 2005, now Pat. No. 7,395,778.

(30) Foreign Application Priority Data

Feb. 12, 2004 (JP) ..... 2004-035800
Jan. 13, 2005 (JP) ..... 2005-006773

(51) Int. Cl.
*B05C 5/02* (2006.01)
*B05C 1/08* (2006.01)

(52) U.S. Cl. ..... 118/300; 118/46; 118/106; 118/257; 118/261; 347/2; 347/85

(58) Field of Classification Search ..... 118/255, 118/257, 216, 217, 106, 120, 261, 46, 300; 399/325; 101/424.2; 427/428.15, 428.17; 347/2, 85

See application file for complete search history.

(56) References Cited

U.S. PATENT DOCUMENTS

| | | | | |
|---|---|---|---|---|
| 3,952,700 | A | 4/1976 | Little, Jr. et al. | 399/102 |
| 4,718,340 | A | 1/1988 | Love, III | 101/116 |
| 4,994,862 | A | 2/1991 | Hoover | 399/325 |
| 5,036,366 | A | 7/1991 | Berg et al. | 399/249 |
| 5,435,848 | A | 7/1995 | Tanokuchi et al. | 118/688 |
| 6,096,380 | A | 8/2000 | Takebe et al. | 427/429 |

(Continued)

FOREIGN PATENT DOCUMENTS

GB 2 351 701 10/2001

(Continued)

*Primary Examiner*—Laura Edwards
(74) *Attorney, Agent, or Firm*—Fitzpatrick, Cella, Harper & Scinto

(57) ABSTRACT

A liquid applying apparatus can prevent an applying liquid from evaporating while an applying operation is stopped and can reliably prevent the liquid from leaking even when, for example, the posture of the apparatus is tilted. An abutting member of a holding member is abutted, under an urging force of a spring, against an applying surface of an applying roller. Thus, a liquid holding space is formed between the applying roller and a holding member to hold the applying liquid. The abutting member is annularly formed of a single member. The applying roller rotates to cause the applying liquid held in the holding space to adhere to an outer peripheral surface of the applying roller. The applying liquid is then applied to the applying medium.

19 Claims, 37 Drawing Sheets

U.S. PATENT DOCUMENTS

| | | | | |
|---|---|---|---|---|
| 6,118,955 | A | 9/2000 | Yoneda et al. | 399/69 |
| 6,183,079 | B1 | 2/2001 | Meade et al. | |
| 6,585,364 | B2 | 7/2003 | Kasperchik et al. | 347/98 |
| 6,663,217 | B2 | 12/2003 | Otsuka et al. | |
| 7,270,409 | B2 | 9/2007 | Iwasaki et al. | |
| 2003/0024474 | A1 * | 2/2003 | Suzuki et al. | 118/258 |
| 2004/0041873 | A1 | 3/2004 | Iwasaki et al. | |
| 2004/0041874 | A1 | 3/2004 | Seki et al. | |
| 2005/0178323 | A1 | 8/2005 | Iwasaki et al. | |
| 2005/0179760 | A1 | 8/2005 | Nakagawa et al. | |

FOREIGN PATENT DOCUMENTS

| | | | | |
|---|---|---|---|---|
| JP | 4-29278 | | 1/1992 | 399/325 |
| JP | 8-58069 | | 3/1996 | |
| JP | 8-72227 | | 3/1996 | |
| JP | 10-118543 | * | 5/1998 | |
| JP | 11-028401 | | 2/1999 | |
| JP | 2001-70858 | | 3/2001 | |
| JP | 2002-96452 | | 4/2002 | |
| JP | 2002-517341 | | 6/2002 | |
| JP | 2003-236428 | | 8/2003 | |
| KR | 2001-52708 | | 6/2001 | |
| WO | WO 01/69324 | * | 9/2001 | |

* cited by examiner

LIQUID APPLYING APPARATUS AND INK JET PRINTING APPARATUS

This application is a division of U.S. patent application Ser. No. 11/052,062, filed Feb. 8, 2005, now U.S. Pat. No. 7,395,778.

BACKGROUND OF THE INVENTION

1. Field of the Invention

The present invention relates to a liquid applying apparatus and an ink jet printing apparatus, and specifically, to a liquid applying apparatus that applies a liquid to a medium for a predetermined purpose, for example, for starting the coagulation of pigments earlier when printing is carried out using inks composed of the pigments as color materials. Likewise, the present invention relates to an ink jet printing apparatus comprising a mechanism that applies the liquid to a print medium used for ink jet printing, for a predetermined purpose, for example, for starting the coagulation of pigments earlier when printing is carried out using inks composed of the pigments as color materials.

2. Description of the Related Art

A spin coater, a roll coater, a bar coater, and a die coater are known as systems for applying a liquid or an aqueous material to various media. These applying systems are premised on continuous applying on relatively long applying media. Thus, for example, if applying media having a relatively small size and intermittently conveyed are to be applied the liquid to, paint beads may be disturbed at a position at which applying is started or ended. In this case, the coats obtained may be non-uniform among the applying media.

A known configuration that can solve this problem is described in Japanese Patent Application Laid-open No. 2001-070858. On the basis of the die coater system, this configuration uses a rotating rod bar and ejects a paint to the rod bar through an ejection slit to form a coat on the rod bar. The coat formed is contacted with and transferred to an applying medium as the rod bar rotates. In this case, when the coat formed on the rod bar is not transferred or applied to the applying medium, the paint is returned to a head by the rotation of the rod bar. The paint is then collected via a collecting slit. In other words, the rod bar continues to rotate even during non-applying, while the paint is being formed into a coat on the rod bar. This enables a uniform coat to be obtained even if applying media are intermittently supplied and applied the paint.

Even in the field of ink jet printing apparatuses, those using a liquid applying mechanism are known. Japanese Patent Application Laid-open No. 2002-517341 describes an apparatus which uses a doctor blade contacting with a roller and in which the application liquid is collected between the blade and the roller so that the application liquid is applied to the roller as the roller rotates. As the roller rotates, the application liquid applied to the roller is transferred and applied to a support conveyed between this roller and another roller. Japanese Patent Application Laid-open No. 08-072227 (1996) similarly discloses a mechanism in an ink jet printing apparatus which applies a treatment liquid before printing which liquid insolubilizes dyes. In Embodiment 1 of this document, the treatment liquid in a replenishing tank is pumped by being attached to the rotating roller. At the same time, the treatment liquid pumped is applied to print paper.

With the configurations described in the above patent documents, an application liquid is applied or supplied to the surface of the rod bar or roller. However, the part of the rod bar or roller to which the application liquid is applied or supplied is open to or in communication with the air. Thus, disadvantageously, the application liquid may be evaporated or for example, the application liquid may leak when the posture of the apparatus is changed.

In particular, with an ink jet printing apparatus such as a printer, in view of, for example, the leakage of the liquid caused by a change in the posture of the apparatus, it is difficult to apply the applying mechanism described in the above documents to the apparatus if its size has been reduced.

In contrast, Japanese Patent Application Laid-open No. 08-058069 (1996) discloses a configuration that seals a part that applies or supplies inks, that is, application liquids, to a roller. The applying mechanism described in this document operates in a gravure printing apparatus to apply inks to a roller (applying roller) having the surface of which is formed with a pattern of a printing plate. This mechanism uses an ink chamber having two doctor blades arranged at two vertical positions along a peripheral surface of the roller and extending in a longitudinal direction of the roller and elastic members provided at the opposite sides of the two doctor blades. The chamber is contacted with the peripheral surface of the roller to form a liquid chamber between the ink chamber and the roller. Then, the roller is rotated to apply or supply the application liquid from the liquid chamber to the roller.

However, the sealing arrangement disclosed in Japanese Patent Application Laid-open No. 08-058069 (1996) may provide an insufficient sealing property. That is, the doctor blades are separate from the elastic members provided at the opposite ends of each of the doctor blades through both doctor blades and elastic members are abutted against the roller for sealing. Thus, for example, the pressure exerted on the roller upon abutment may vary significantly between these members. In this case, the abutting pressure differs markedly between the junctions between the doctor blades and the elastic members and the other parts. Thus, the sealing may be insufficient in parts with a lower abutting pressure, resulting in the leakage of the liquid. If the abutting pressure itself is set at a large value in order to prevent the leakage of the liquid caused by the non-uniform abutting pressure, the application of inks to the roller may be unsatisfactory, which application is carried out by the blades and the roller in cooperation.

Moreover, in Japanese Patent Application Laid-open No. 08-058069 (1996), the ink chamber comprising the doctor blades and the elastic members is moved by engaging the ink chamber with a shaft in which a thread groove is formed and then rotating the shaft. The abutting pressure between the roller and the doctor blades and elastic members is exerted by simply fixing the position of the chamber. Thus, for example, if there are small concaves and convexes on the peripheral surface of the roller, the abutment does not conform to the concaves and convexes. This may degrade the sealing property to prevent inks from being favorably applied to the roller.

Further, Japanese Patent Application Laid-open No. 08-058069 (1996) describes the doctor blades provided to scrape extra inks adhering to the surface of the roller. Accordingly, this document does not disclose the configuration of blades or abutting portions which are preferred in association with the sealing property if the liquid is applied to the entire surface of a medium such as paper which has a certain thickness.

As described above, in association with the supply of the coating liquid to the roller, an arrangement is important which uses the abutting portion to appropriately seal the coating liquid chamber formed between the abutting portion and the roller. More specially, it is extremely important to provide the liquid holding space with a good sealing condition in order to keep a good quality of the applying liquid and enhance a handling ability of the applying apparatus in moving and transporting it. Accordingly, it is required to prevent the applying liquid from being evaporated and/or leaked while a roller remains stopped for a long time and when the posture of the applying apparatus happens to be tilted.

SUMMARY OF THE INVENTION

It is an object of the present invention to provide a liquid applying apparatus which can prevent an applying liquid from evaporating while an applying operation is at a stop and which can reliably prevent the liquid from leaking even when for example, the posture of the apparatus is tilted.

A first aspect of the present invention provides a liquid applying apparatus comprising a applying member which applies a liquid to a medium and which has a applying surface and a liquid holding member that abuts against the applying surface of the applying member to form a liquid holding space in which the liquid is held, the applying surface of the applying member being rotatively moved to apply the liquid supplied to the applying surface to the applying medium, the apparatus being characterized in that an abutting portion of the liquid holding member which abuts against the applying surface of the applying member is annularly formed of a single member.

Further, a second aspect of the present invention provides a printing apparatus characterized by comprising conveying means for conveying a print medium along a predetermined conveying path, printing means for printing the print medium, and a liquid applying mechanism that applies a liquid to the print medium conveyed along the conveying path, wherein the liquid applying mechanism comprises a applying member which applies a liquid to a medium and which has a applying surface and a liquid holding member that abuts against the applying surface of the applying member to form a liquid holding space in which the liquid is held, the applying surface of the applying member is rotatively moved to apply the liquid supplied to the applying surface to the applying medium, and an abutting portion of the liquid holding member which abuts against the applying surface of the applying member is annularly formed of a single member.

According to the present invention, a sufficient liquid-tight state can be established between the applying surface and the abutting portion. This makes it possible to prevent the applying liquid supplied to the liquid holding space from evaporating even if the apparatus is not used for a long period. Moreover, the present invention can prevent the applying liquid from leaking even if the whole apparatus is tiled during movement, transportation, or the like.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described below in detail with reference to the accompanying drawings.

First Embodiment

According to the present embodiment, if the applying operation is not performed, a liquid is collected from a liquid holding space formed between an applying roller and a liquid holding member to hold the liquid.

Figure 1:
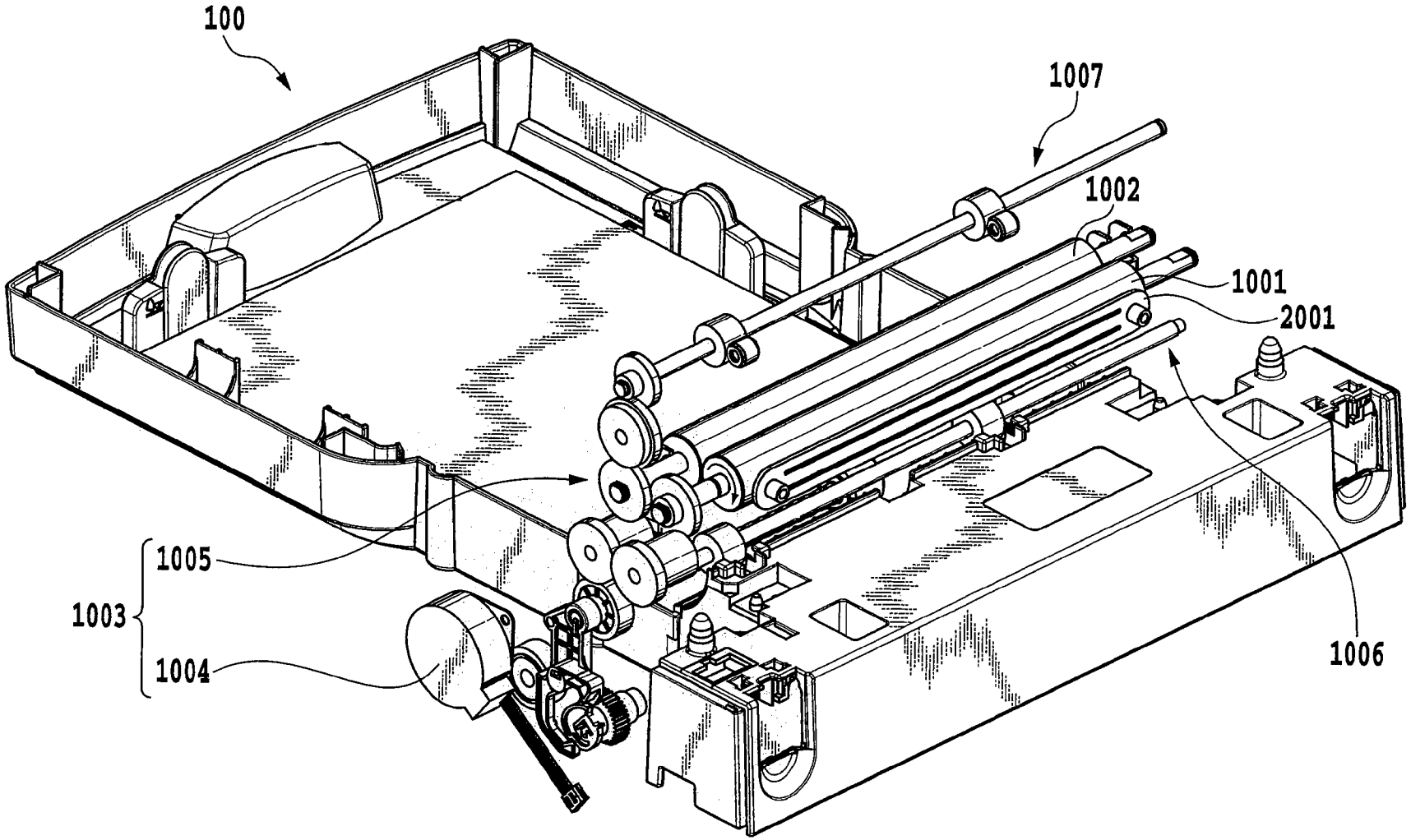
FIG. 1 is a perspective view generally showing the configuration of an embodiment according to a liquid applying apparatus of the present invention.

FIG. 1 is a perspective view generally showing the configuration of an embodiment according to a liquid applying apparatus 100 of the present invention. The liquid applying apparatus shown in FIG. 1 roughly has liquid applying means for applying a predetermined application liquid to a medium to which a liquid is to be applied (this medium will be referred to as a applying medium in the description below) and liquid supplying means for supplying a application liquid to the liquid applying means.

The liquid applying means has a cylindrical applying roller 1001, a cylindrical counter roller (medium supporting member) placed opposite the applying roller 1001, and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

The liquid supplying means has, for example, a liquid holding member 2001 that holds the application liquid between the liquid holding member 2001 and a peripheral surface of the applying roller 1001, and a liquid channel 3000 (not shown in FIG. 1) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

The liquid applying apparatus according to the present embodiment further comprises an applying medium supplying mechanism 1006 which consists of a pickup roller or the like to convey an applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey a applying medium on which the application liquid has been applied, to a sheet discharging section (not shown). Like the applying roller and the like, the sheet supplying mechanism and the sheet discharging mechanism are operated under the driving force of the driving motor 1004 transmitted via the transmission mechanism 1005.

The application liquid used in the present embodiment is intended to facilitate the coagulation of pigments when printing has been carried out using inks including the pigments as color materials.

An example of the components of the application liquid is shown below.

Tetrahydrate of calcium nitrate: 10%

Glycerin: 42%

Surface active agent: 1%

Water: remaining amount

The application liquid has a viscosity of 5 to 6 cp (centipoise) at 25° C.

In applications of the present invention, of course, the application liquid is not limited to the one described above. For example, a liquid including a component which insolubilizes or coagulate a dye may be used as another application liquid.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension.

Now, a detailed description will be given of the elements of the sections of the applying apparatus described above in brief.

Figure 2:
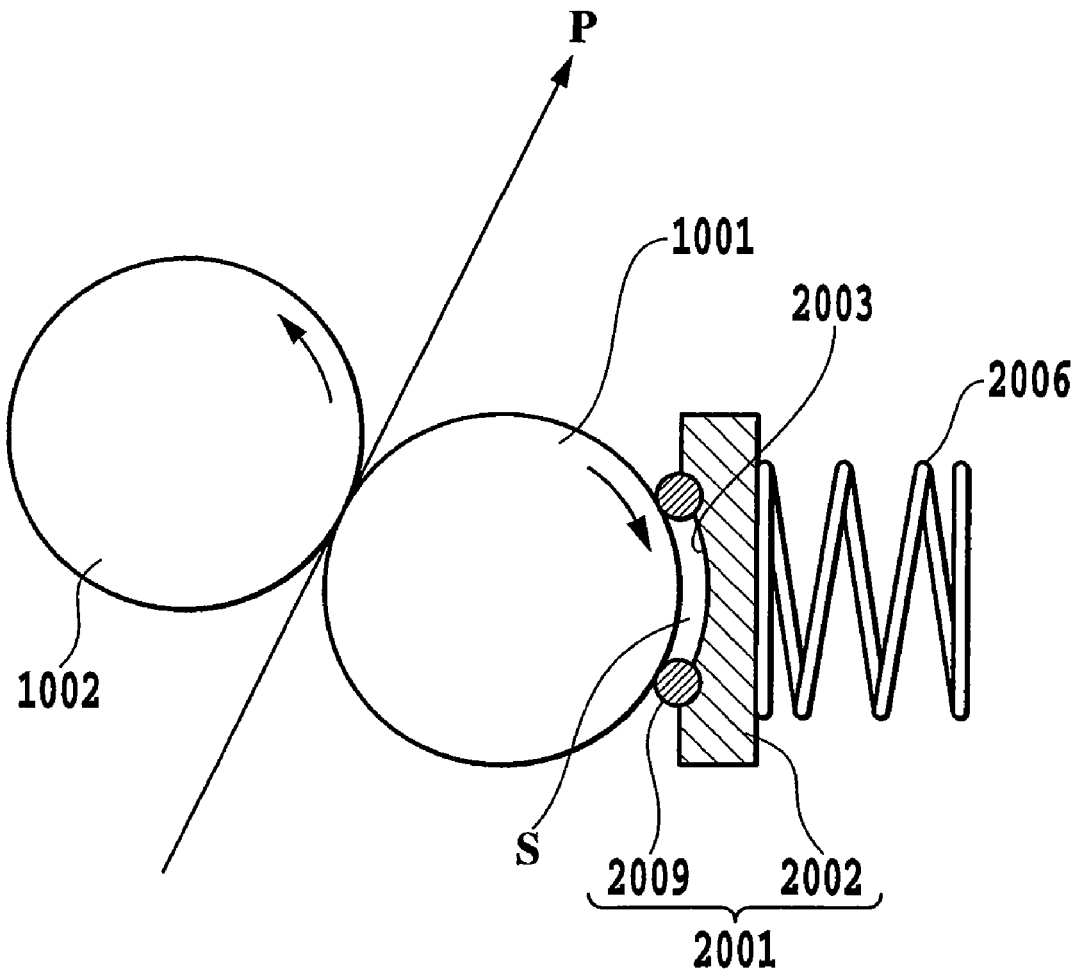
FIG. 2 is a vertical side view showing an example of the arrangement of a applying roller, a counter roller, a liquid holding member, and the like which are shown in FIG. 1.

FIG. 2 is a vertical sectional view illustrating an example of the arrangement of the applying roller 1001, the counter roller 1002, and the liquid holding member 2001.

The counter roller 1002 is biased by biasing means (not shown) toward the peripheral surface of the applying roller 1001. By rotating the applying roller 1001 clockwise in the figure, it is possible to sandwich an applying medium P on which the application liquid is to be applied, between the rollers, while conveying the applying medium P in the direction of an arrow in the figure.

According to the present embodiment, the applying roller is formed of silicon rubber and has a hardness of 40°, a surface roughness Ra of 1.6 μm, and a diameter of 23.169 mm. The counter roller 1002 is formed of iron and has a diameter of 14 mm.

Further, when urged and abutted against the peripheral surface of the applying roller 1001 under the biasing force of a spring member (pressing means) 2006, the liquid holding member 2001 forms an elongate liquid holding space S extending all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

FIGS. 3 to 8 show the configuration of the liquid holding member 2001.

Figure 3:
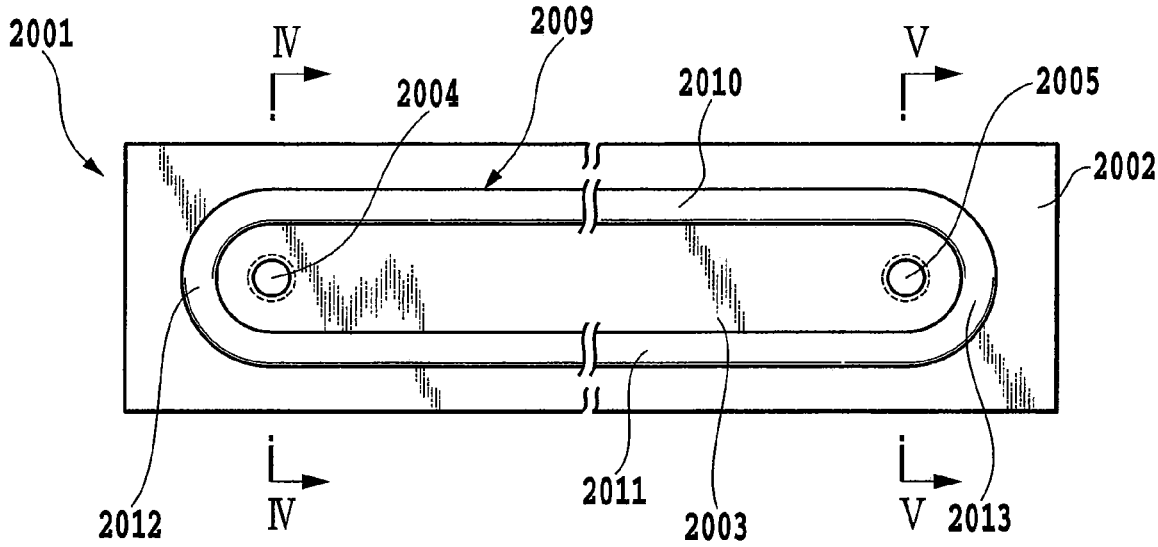
FIG. 3 is a front view of the liquid holding member shown in FIGS. 1 and 2.

As shown in FIG. 3, the liquid holding member 2001 has a space forming base material 2002 and an annular abutting member 2009 located on one surface of the space forming base material 2002. A concave portion 2003 is formed in a central portion of the space forming base material 2002 along its longitudinal direction; a bottom portion of the concave portion 2003 has a circular cross section. The abutting member 2009 has linear portions fastened along the upper edges of the concave portion 2003 and circumferential portions fastened so as to extend from the upper edge through the bottom portion to the opposite upper edge. Thus, when the abutting member 2009 of the liquid holding member 2001 abuts against the applying roller 1001, the abutment conforms to the shape of the peripheral surface of the applying roller. It is thus possible to achieve the abutment at a uniform pressure.

As described above, in the liquid holding member according to this embodiment, the abutting member 2009, formed integrally and seamlessly, is continuously abutted without a gap against the outer peripheral surface of the applying roller 1001 under the biasing force of the spring member 2006. As a result, the liquid holding space S is substantially closed by the abutting member 2009, one surface of the space forming base material, and the outer peripheral surface of the applying roller 1001. The liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior. On the other hand, when the applying roller 1001 rotates, the applying liquid flows slippery between the outer peripheral surface of the applying roller 1001 and the abutting member 2009. The applying liquid then adheres to the outer peripheral surface of the applying roller in layers. In this case, when the applying roller 1001 is stopped and the liquid tight state is established between the outer peripheral surface of the applying roller 1001 and the abutting member 2009, the liquid cannot flow out of the space as described above. In this case, the abutting state of the abutting member 2009 includes not only direct abutment against the outer peripheral surface of the applying roller 1001 but also abutment against the outer peripheral surface via a liquid film formed under a capillary force.

Figure 4:
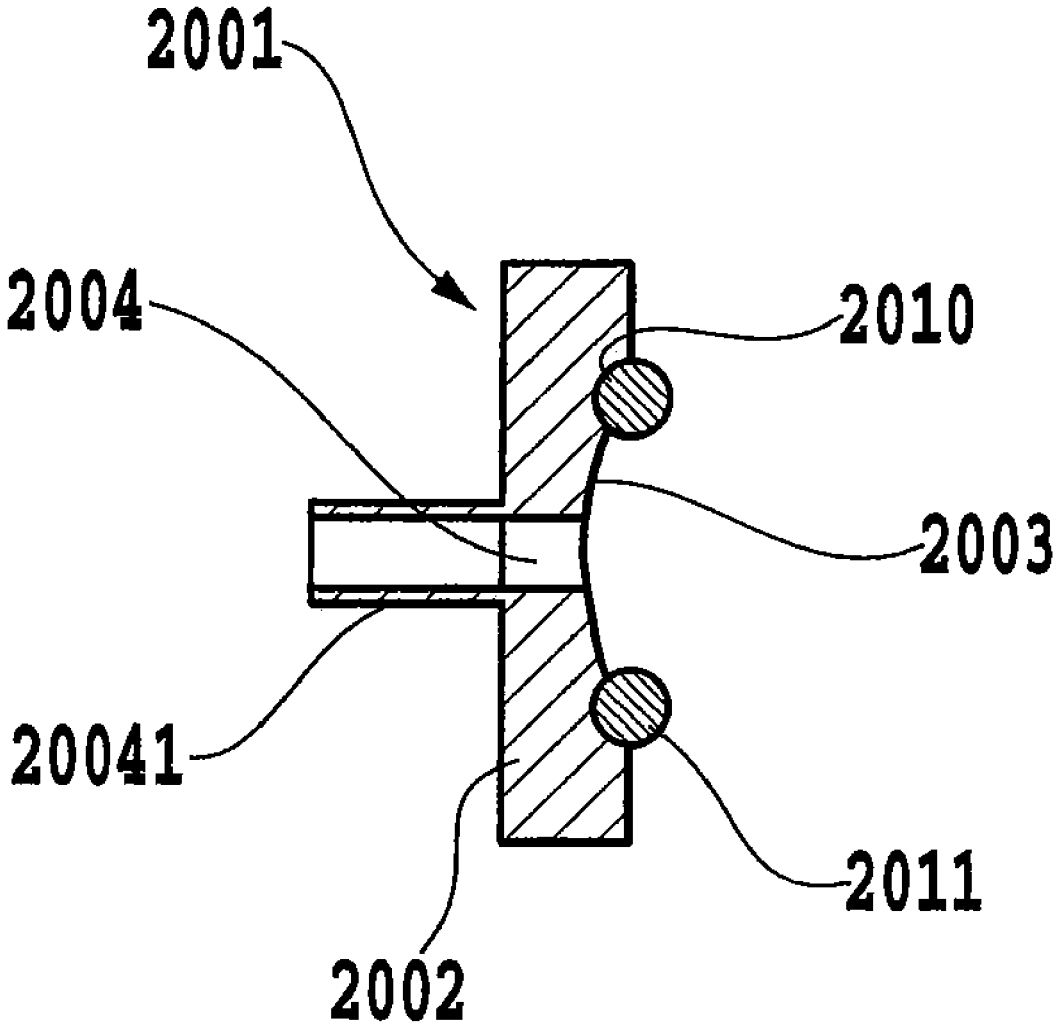
FIG. 4 is an end view showing an end surface of the liquid holding member shown in FIG. 3, the view taken along line IV-IV in FIG. 3.
Figure 5:
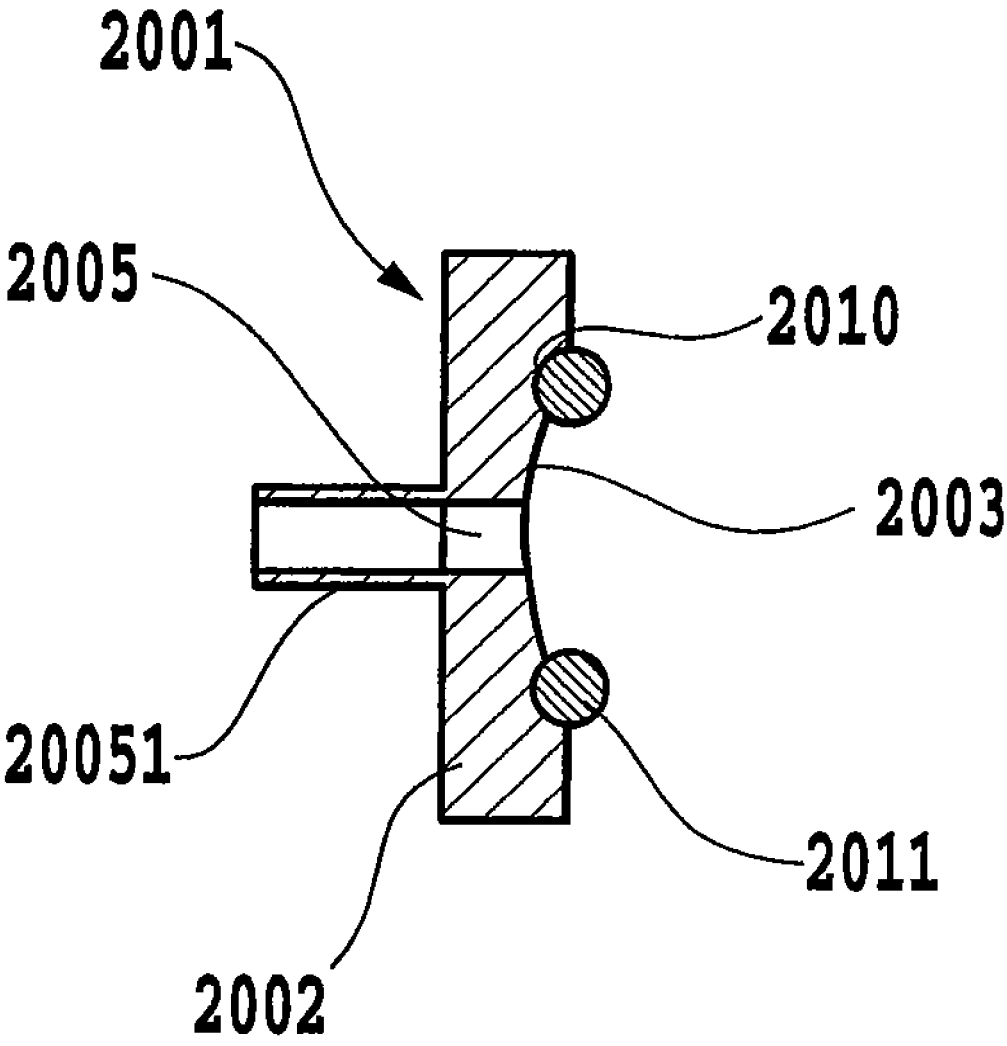
FIG. 5 is an end view showing the end surface of the liquid holding member shown in FIG. 3, the view taken along line V-V in FIG. 3.
Figure 6:
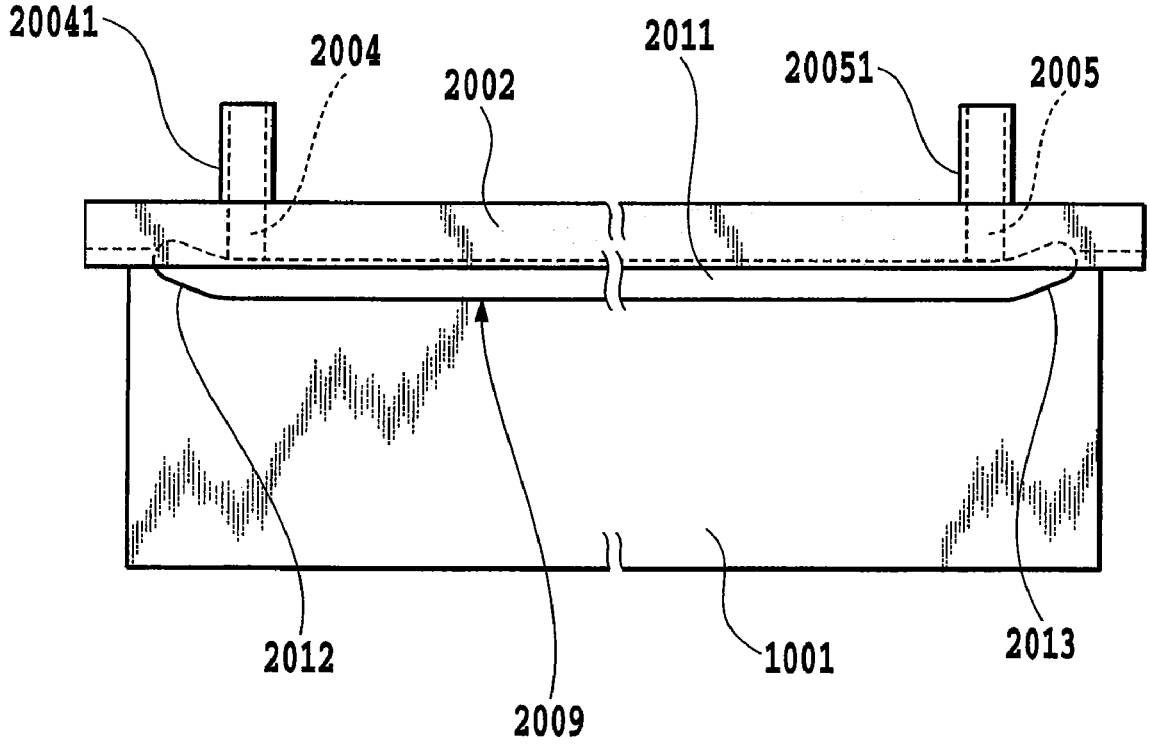
FIG. 6 is a plan view of the liquid holding member shown in FIG. 3.
Figure 7:
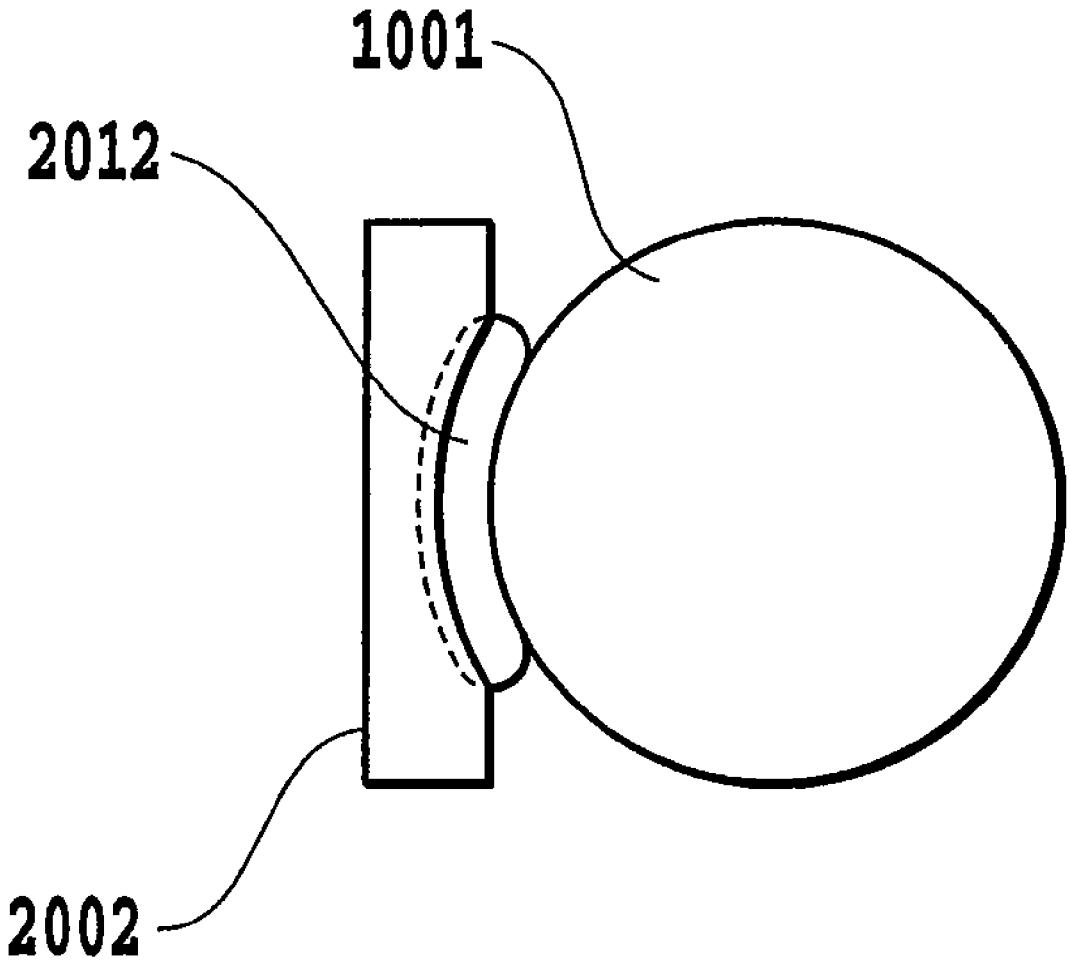
FIG. 7 is a left side view showing how an abutting portion of the liquid applying member shown in FIG. 3 is abutted against a liquid applying roller.
Figure 8:
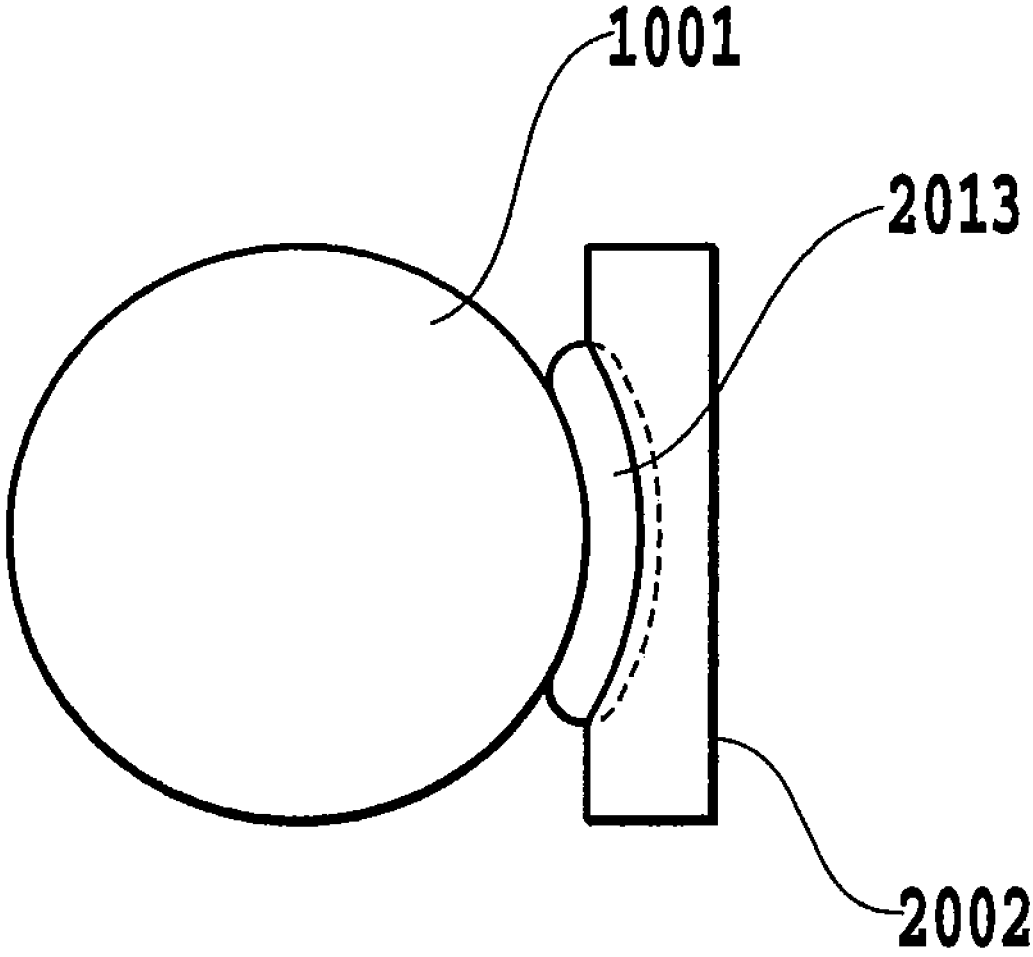
FIG. 8 is a right side view showing how the abutting portion of the liquid applying member shown in FIG. 3 is abutted against the liquid applying roller.

As shown in FIGS. 3 to 8, the longitudinally opposite sides of the abutting member 2009 are gently curved as viewed from its front (FIG. 3), from above (FIG. 6), or from its side (FIGS. 7 and 8). Thus, even when the abutting member 2009 is abutted against the applying roller 1001 under a relatively high pressure, the whole abutting member 2009 is substantially uniformly elastically deformed. This prevents large distortions locally. Thus, as shown in FIGS. 6 to 8, the abutting member 2009 abuts tightly without the gap against the outer peripheral surface of the applying roller 1001. As a result, a substantially closed space can be formed as described above.

On the other hand, as shown in FIGS. 3 to 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and flowout of the application liquid allows the liquid to flow from the left end to right end of the liquid holding space S.

FIGS. 29 to 32 are sectional views of the abutting portion between the applying roller 1001 and the liquid holding member 2001. With reference to FIGS. 29 to 32, description will be given of a position where the liquid holding member 2001 is brought into pressure contact with the applying roller 1001. The applying roller 1001 rotates in the directions of arrows in the figures to apply the liquid to the print medium. The abutting portion of the liquid holding member 2001 has an upper edge 2010 and a lower edge 2011 which extend in a direction crossing the one in which the applying roller 1001 is rotatively moved, and a left edge 2012 and a right edge 2013 which extend along the rotative moving direction of the applying roller 1001 (see FIG. 3). For the surfaces of the right edge 2010 and lower edge 2011 which abut against the applying member 1001, the abutting surface located downstream in the rotative moving direction of the applying member 1001 is called an abutting surface F1. The abutting surface located upstream in the rotative moving direction of the applying member 1001 is called an abutting surface F2.

Figure 29:
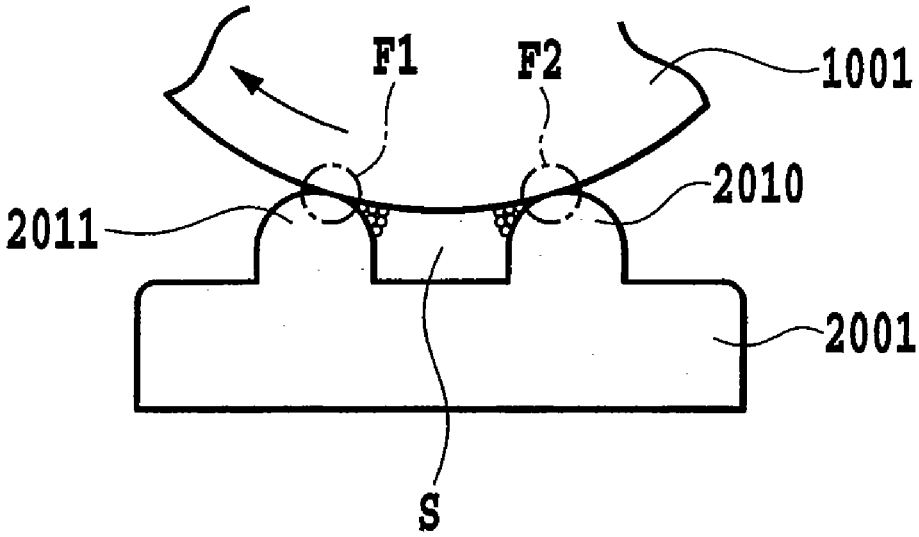
FIG. 29 is a sectional view of the applying roller and the liquid holding member, in which the liquid holding member is brought into pressure contact with the applying roller from below in a vertical direction.

If the liquid holding member 2001 is placed, in a vertical direction, below a horizontal line passing through a rotational center of the applying roller 1001 as shown in FIG. 29, the liquid holding space S is entered by an amount of air corresponding to the transfer to the applying roller 1001. Consequently, bubbles are generated in the liquid holding space S. Thus, the bubbles remain on the applying abutting surface F1. Further, when the amount of liquid in the liquid holding space S decreases, the level may not reach the peripheral surface of the applying roller 1001. As a result, stable applying cannot be achieved in this state. The bubbles also remain on the applying abutting surface F1 if the applying abutting surface F1 of liquid holding member 2001 is placed above its non-applying abutting surface F2. Therefore, when the applying abutting surface F1 between the applying roller 1001 and the liquid holding member 2001 is placed below the non-applying abutting surface F2, the bubbles associated with the supply of the liquid are collected at the non-applying abutting surface F2. Stable applying is thus accomplished.

As described below, according to the present embodiment, when the apparatus is powered off or if for example, no print instruction has been transmitted for a specified time, a collecting operation is performed to collect the applying liquid from the liquid holding space S and liquid channel 3000.

Figure 30:
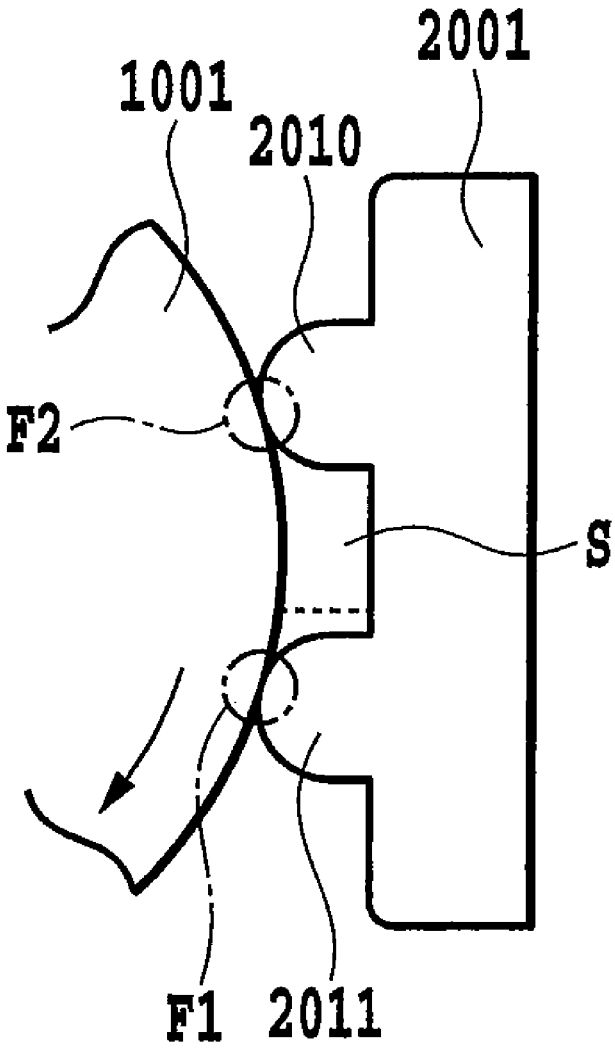
FIG. 30 is a sectional view showing the liquid holding member placed on a horizontal line passing through a rotational center of the applying roller.

Now, consideration will be given of the case in which the liquid holding member 2001 is placed on the horizontal line passing through the rotational center of the applying roller 1001 as shown in FIG. 30. In this case, the applying abutting surface F1 is located below the non-applying abutting surface F2 in the vertical direction. Further, the liquid holding member 2001 is pressed against the applying roller 1001 in a horizontal direction. In this state, when the applying liquid is collected, the liquid remains in the applying abutting surface F1 of the liquid holding member 2001. When the apparatus is left in this liquid remaining state for a long time, the leakage of the liquid may occur while the apparatus is being transported. The liquid also remains in the applying abutting surface F1 during the collecting operation even if the liquid holding member 2001 is placed, in the vertical direction, above the horizontal line passing through the rotational center of the applying roller 1001.

Figure 31:
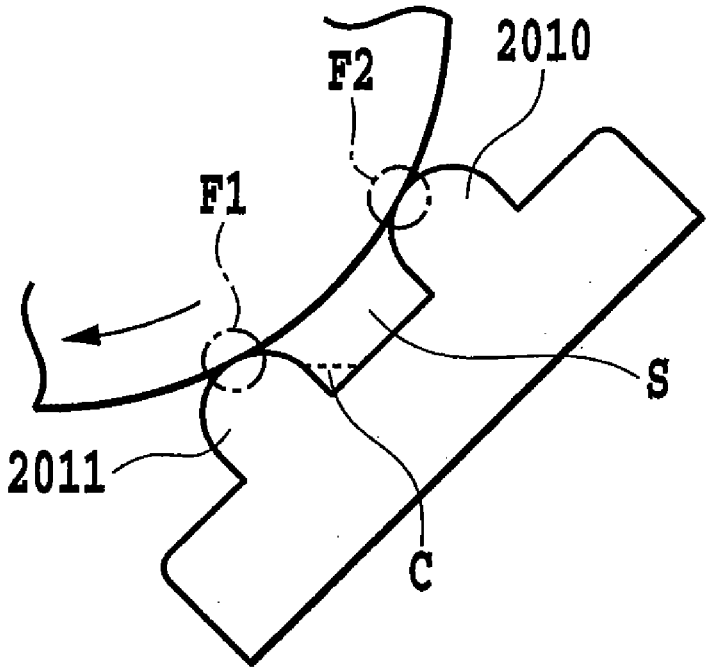
FIG. 31 is a sectional view showing how the liquid holding member is placed so that a liquid applying space is partly located below the applying abutting surface.

Accordingly, as shown in FIG. 31, the liquid holding member 2001 is placed so that the liquid holding space S partly includes a space below the applying abutting surface F1. Thus, the liquid is gathered at a root C of the projecting portion of the liquid holding member 2001. This reduces the amount of liquid remained at the applying abutting surface F1 during collecting liquid to the storage tank. The above problem can thus be prevented. To allow the liquid to be gathered at the root C of the projecting portion, it is necessary to press the liquid holding member 2001 against the applying roller 1001 upward from the horizontal line. In this case, even in view of the tolerances of the parts, errors in mounting of the parts, errors in the flexure of the liquid holding member 2001 caused by the elasticity of its material, and the like, it is sufficient to mount the liquid holding member 2001 relative to the applying roller 1001 so that the pressing direction is inclined at at least 10° from the horizontal in a forward rotating direction.

Figure 32:
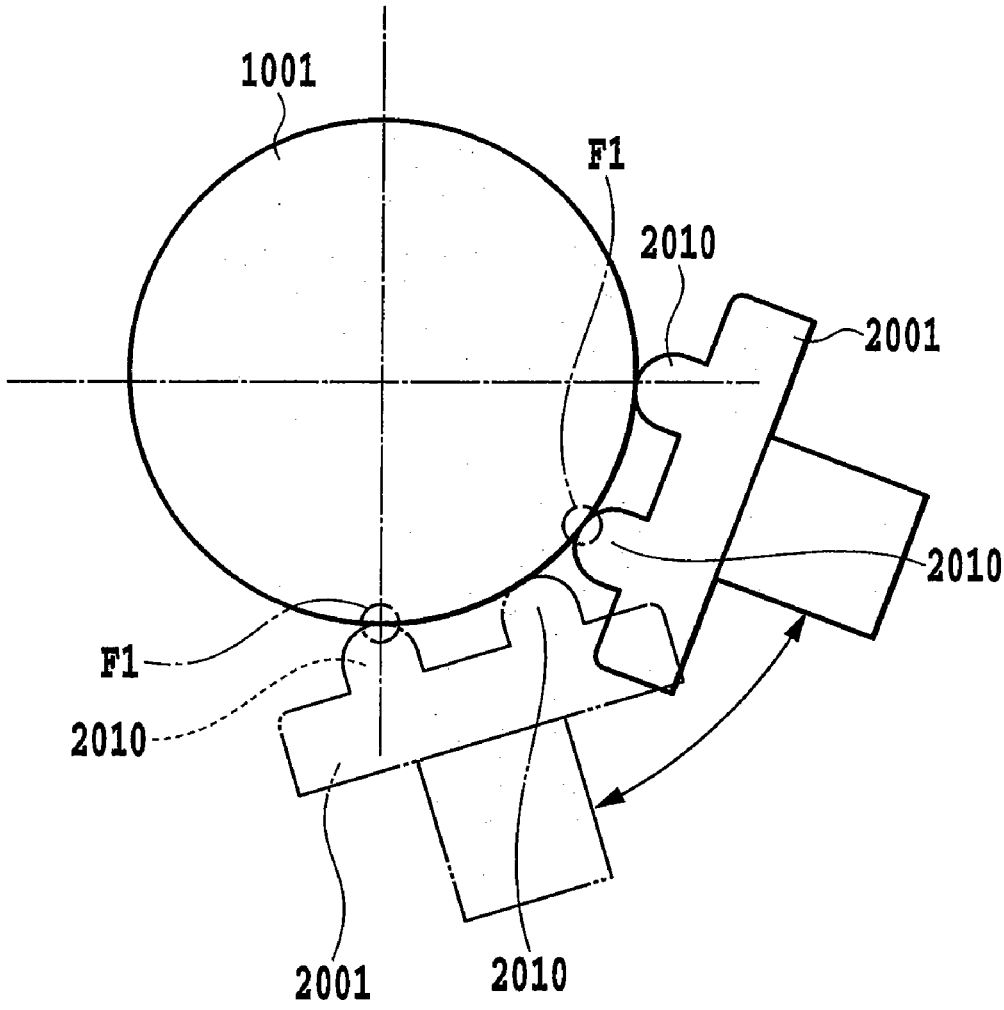
FIG. 32 is a sectional view of the applying roller and the liquid holding member, showing an area effectively used as a position where the liquid holding member is brought into pressure contact with the applying roller.

As described above, the liquid holding member 2001 is desirably placed so that its applying abutting surface F1 is below its non-applying abutting surface F2 and that the liquid holding member 2001 is pressed against the applying roller 1001 in a direction inclined upward from the horizontal position in the vertical direction at least 10°. In other words, the liquid holding member 2001 is desirably placed in such an area as shown in FIG. 32, relative to the applying roller 1001. This prevents bubbles from remaining at the applying abutting surface F1 between the applying roller 1001 and the liquid holding member 2001 during the applying operation. Further, during the collecting operation, the amount of liquid remaining at the abutting surfaced F1 decreases.

In the present embodiment, the applying abutting surface F1 is set below that the non-applying abutting surface F2. The applying roller 1001 and the liquid holding member 2001 are arranged so that the midpoint between the upper edge 2010 and lower edge 2011 of the liquid holding member 2001 is on a straight line inclined, in the forward rotating direction, at 45° from the horizontal line passing through the rotational center of the applying roller 1001.

(Application Liquid Channel)

Figure 11:
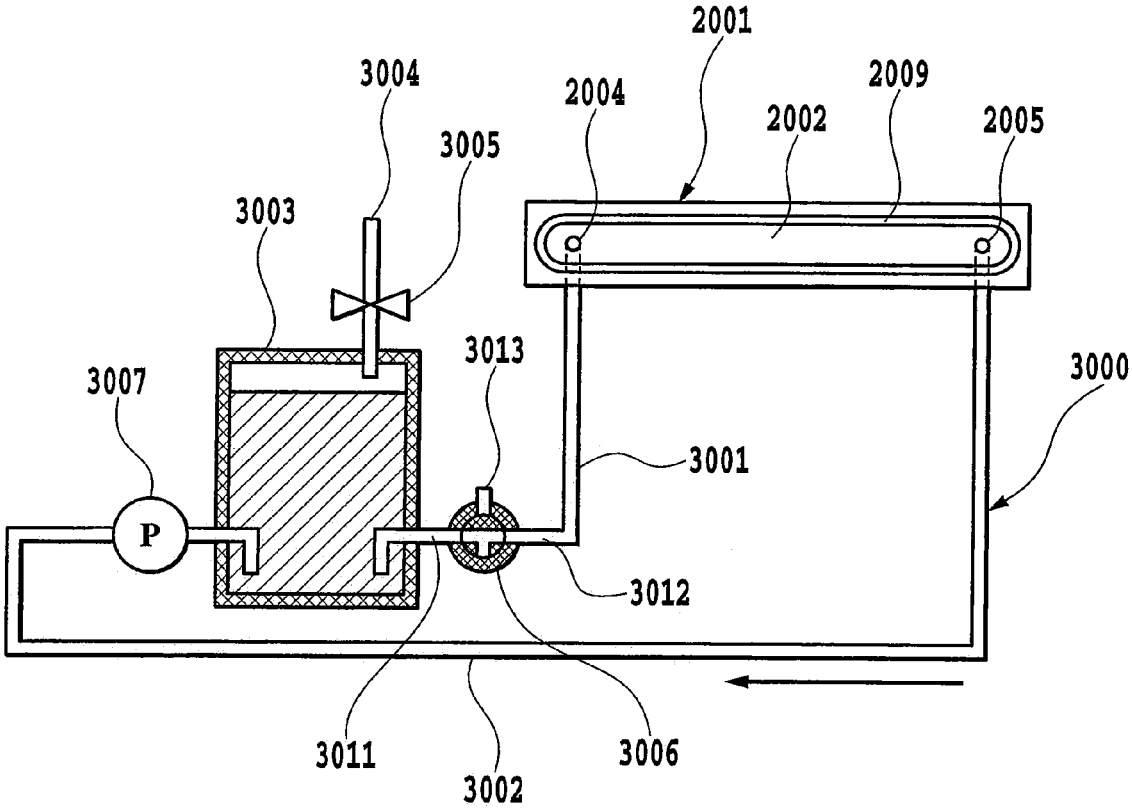
FIG. 11 is a diagram generally showing the configuration of a liquid channel in the liquid applying apparatus according to the embodiment of the present invention.

FIG. 11 is a diagram generally illustrating the configuration of the liquid channel (supplying channel) 3000, connected to the liquid holding member 2001 of the application liquid supplying means.

The liquid channel 3000 has a first channel 3001 that connects the liquid supplying port 2004 of the space forming base member 2002, constituting the liquid holding member 2001, to a storage tank 3003 that stores the application liquid, a second channel (collecting channel) 3002 that connects the liquid collecting port 2005 of the space forming base material 2002 to the storage tank 3003 together. An air communicating port 3004 is formed in the storage tank 3003. The air communicating port 3004 is provided with an air communicating valve 3005 that selectively switches between a communicating state for the air and a closed state for the same. Further, the first channel 3001 is provided with a selector valve 3006. The selector valve 3006 switches between a communicating state of the first channel 3001 with the air and a closed state of the same. Moreover, the second channel 3002 connects to a pump 3007 used to force the application liquid and air to flow through the liquid channel 3000 in a desired direction. In this embodiment, the pump generates a flow of the liquid in a direction from the first channel 3001 to the second channel 3002 via the liquid holding space S (as shown by an arrow in FIG. 11).

In this embodiment, the first channel 3001 and the second channel 3002 are formed of cylindrical tubes. An opening formed at an end of each tube is placed at the bottom of the storage tank 3003 or close to the bottom. The position of the opening allows the application liquid in the storage tank 3003 to be completely consumed.

According to this embodiment, various types of the selector valves 3006 are applicable provided that they selectively enable and disable the communication between the first channel 3001 and the air. In this case, a three-way valve is used as shown in FIG. 11. The three-way valve 3006 has three ports that are in communication with one another. It is possible to allow two of the three ports to selectively communicate with any two of the storage tank tube 3011 in the first channel 3001, liquid holding member tube 3012, and air communicating port 3013. The three-way valve 3006 is selectively switched between a connected state in which the tubes 3011 and 3012 are in communication with each other and a connected state in which the tube 3012 and the air communicating port 3013 are in communication with each other. This enables the application liquid in the storage tank 3003 or air obtained through the air communicating port 3013 to be selectively supplied to the space S formed by the liquid holding member 2001 and the applying roller 1001. The switching of the three-way valve 3006 is carried out in accordance with a control signal from a control section 4000 described later. Thus, the application liquid is filled or supplied.

(Control System)

Figure 12:
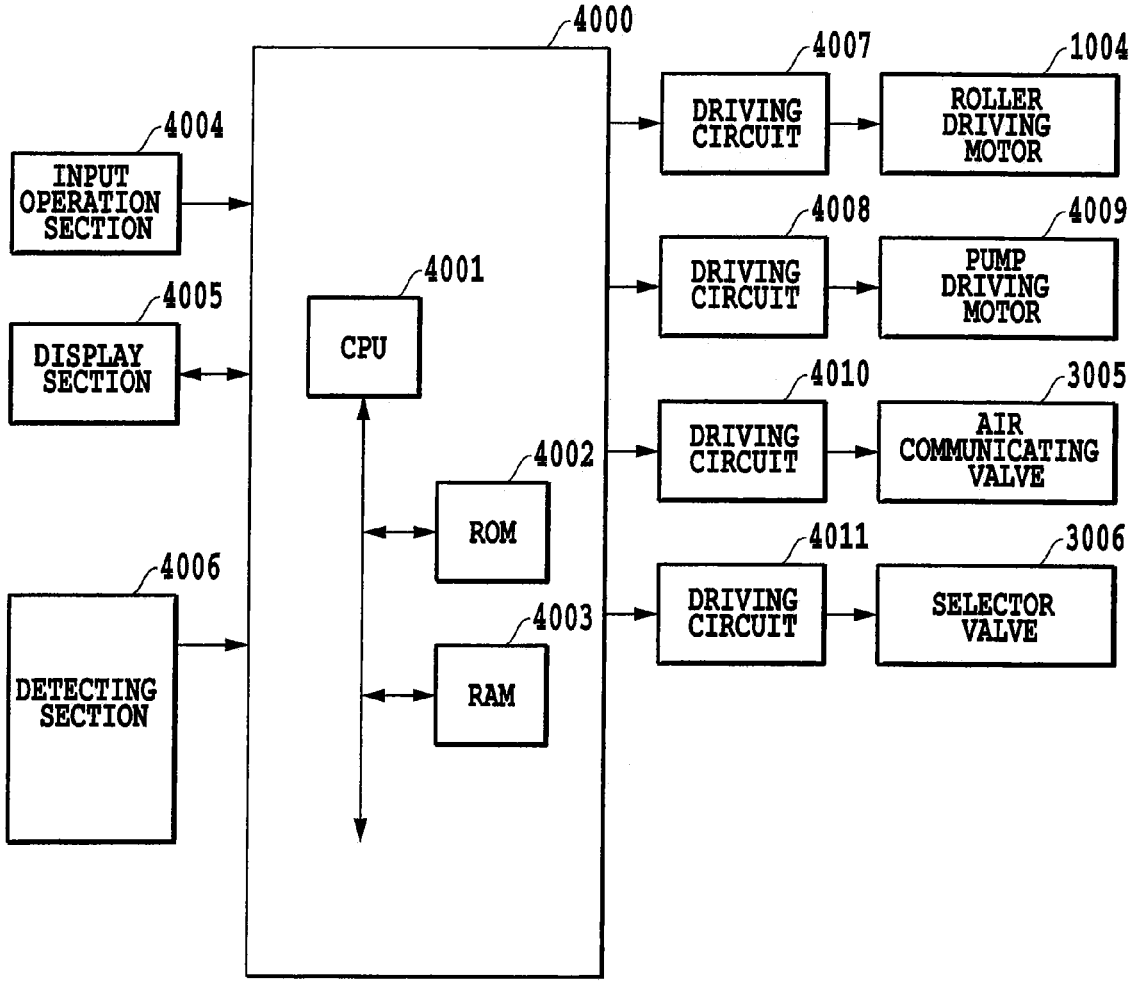
FIG. 12 is a block diagram generally showing the configuration of a control system according to the embodiment of the present invention.

FIG. 12 is a block diagram generally showing the configuration of the control system in the liquid applying apparatus according to the present embodiment.

In FIG. 12, the control section 4000 operates as control means for controlling the whole liquid applying apparatus. The control section 4000 has a CPU 4001 that performs various process operations such as calculations, control, and determinations, a ROM 4002 that stores, for example, control programs for processes executed by the CPU 4001, such as the one described later in FIG. 13, and a RAM 4003 that temporarily stores data used during process operations of the CPU 4001 as well as input data.

The control section 4000 connects to an input operation section 4004 including a keyboard, various switches, or the like with which predetermined instructions or data are input, a display section 4005 that provides various displays including inputs to and the set state of the liquid applying apparatus, and a detecting section 4006 including a sensor or the like which detects the position of a applying medium or the operational state of each section. The control section 4000 also connects to the roller driving motor 1004, a pump driving motor 4009, an air communicating valve 3005, and the selector valve 3006, via driving circuits 4007, 4008, 4010, and 4011.

(Liquid Applying Operation Sequence)

Figure 13:
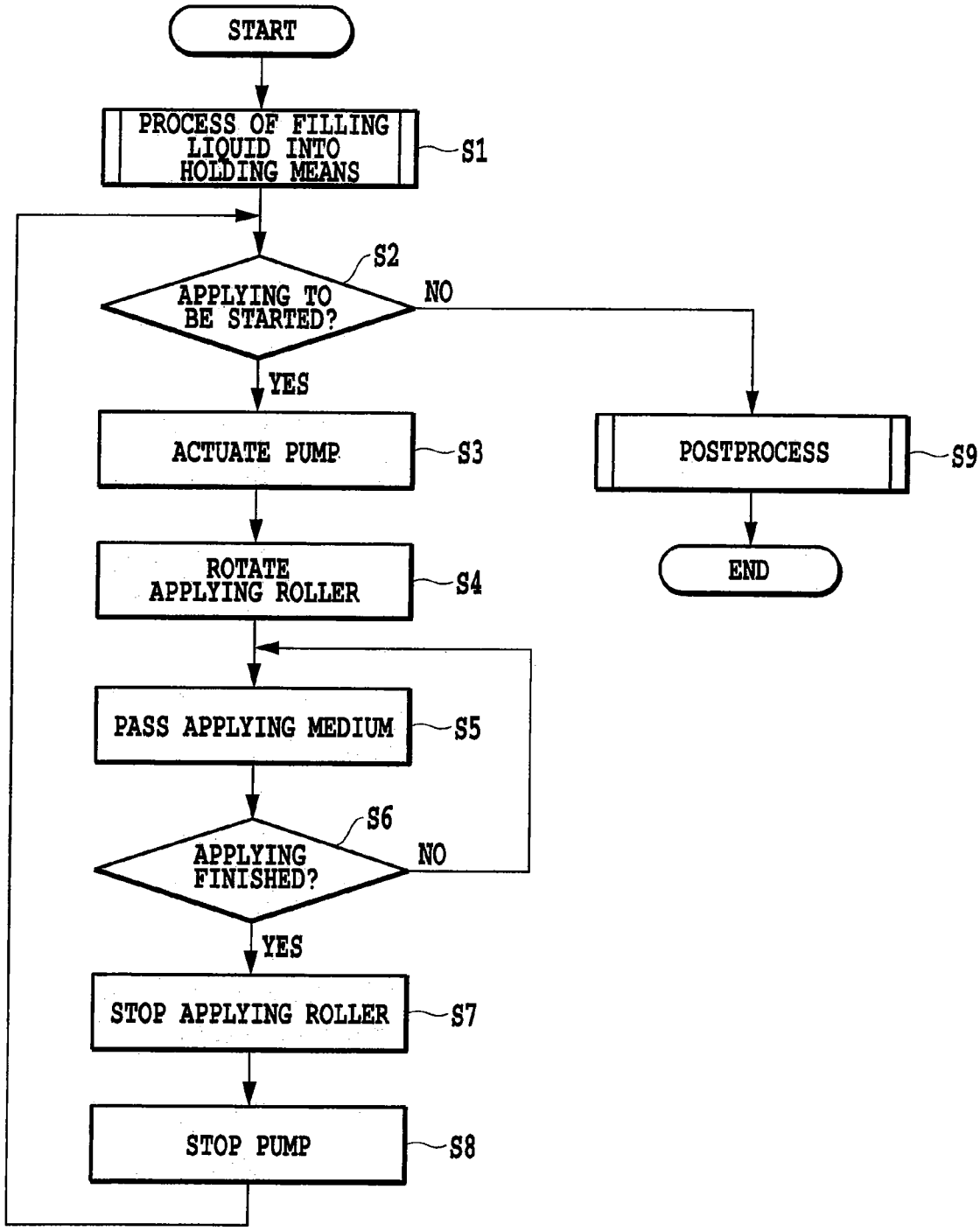
FIG. 13 is a flowchart showing a liquid applying operation sequence according to the embodiment of the present invention.

FIG. 13 is a flowchart showing a process procedure for applying a liquid in the liquid applying apparatus according to the present embodiment. The steps of liquid application will be described below with reference to this flowchart.

When the liquid applying apparatus is powered on, the control section 4000 executes an applying operation sequence described below, in accordance with the flowchart shown in FIG. 13.

Filling Step

Figure 19:
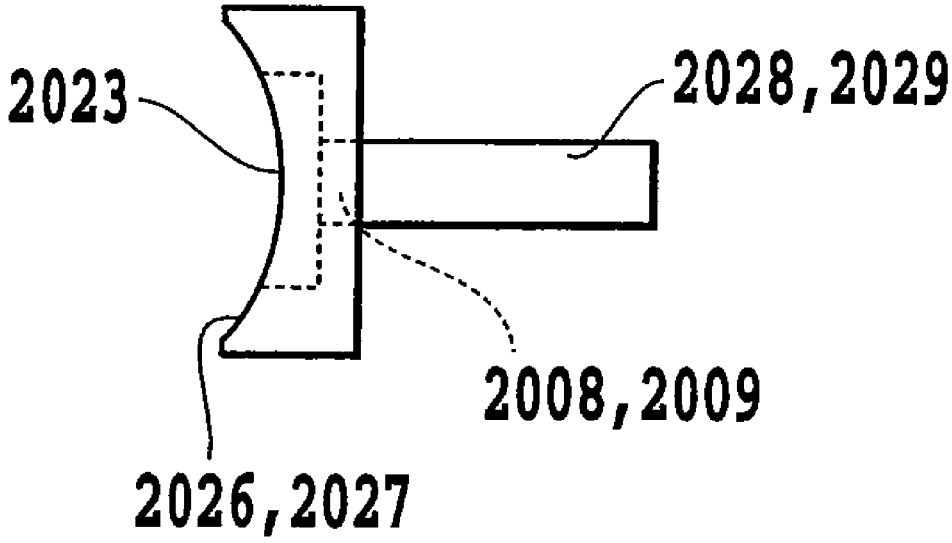
FIG. 19 is a side view of the liquid holding member shown in FIG. 18.

In step S1, the liquid holding space S is filled with the application liquid. In this filling step, the air communicating valve 3005 of the storage tank 3003 is first opened to the air. The selector valve (three-way valve) 3006 is also switched as shown in FIG. 19. This allows the tubes 3011 and 3012 to communicate with each other to drive the pump 3007 for a specified time. Thus, air and/or the application liquid flows from the pump 3007 to the storage tank 3003. Accordingly, if the liquid holding space S and the channels 3001 and 3002 have not been filled with the application liquid, the pump drives the air inside the space and channels out to the storage tank 3003. The air is then discharged to the exterior of the apparatus. These portions are then filled with the application liquid. On the other hand, if these portions have already been filled with the application liquid, the application liquid in these portions starts to flow. These portions are thus supplied with an application liquid having an appropriate concentration and viscosity. This initial operation allows the application liquid to be supplied to the applying roller 1001. It is thus possible to apply the application liquid to the applying medium.

Applying Step

Then, an applying start instruction is input (step S2). Then, the pump 3007 restarts operation (step S3). The applying roller starts rotating clockwise as shown by an arrow in FIG. 1 (step S4). The rotation of the applying roller 1001 causes the application liquid L filled into the liquid holding space S to slippery flow between the applying roller 1001 and a lower edge 2011 of the abutting member 2009 against the pushing force of the abutting member 2009 of the liquid holding member 2001, which force acts on the applying roller 1001. The application liquid adheres to the outer periphery of the applying roller 1001 in layer form. The application liquid L adhering to the applying roller 1001 is transferred to the abutting portion between the applying roller 1001 and the counter roller 1002.

Figure 9:
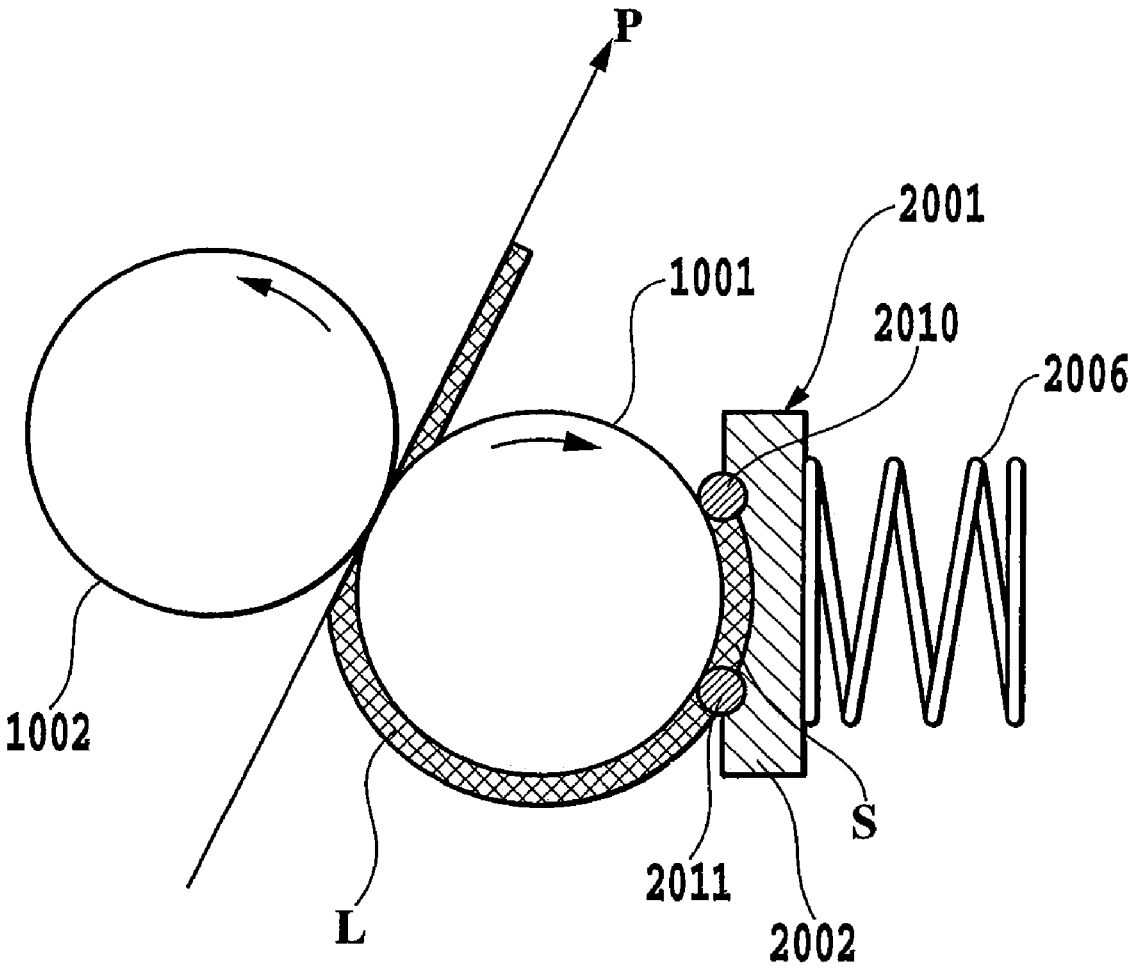
FIG. 9 is a vertical sectional view showing how a applying liquid is filled into a liquid holding space formed by the liquid holding member and the applying roller and how a liquid is applied to a applying medium by the rotation of the applying roller.

Then, an applying medium supplying mechanism 1006 conveys an applying medium to between the applying roller 1001 and the counter roller 1002. The applying medium is inserted between these rollers and conveyed to a sheet discharging section as the applying roller 1001 and the counter roller 1002 rotate (step S5). During this conveyance, the application liquid applied to the peripheral surface of the applying roller is transferred from the applying roller 1001 to the applying medium P as shown in FIG. 9. Of course, means for supplying an applying medium to between the applying roller 1001 and the counter roller 1002 is not limited to the above supplying mechanism. It is possible to use any means, for example, manual means which uses a predetermined guide member or which is solely used.

In FIG. 9, an area with crossing oblique lines denote the application liquid L. In this case, the application liquid on the applying roller 1001 and applying medium P is shown considerably thicker than the actual one in order to clearly illustrate how the application liquid L is applied.

As described above, an applied part of the applying medium P is conveyed in the direction of the arrow under the conveying force of the applying roller 1001. Further, an unapplied part of the applying medium P is conveyed to the contact portion between the applying medium P and the applying roller 1001. This operation is continuously or intermittently performed to apply the application liquid to the entire applying medium.

FIG. 9 shows the ideal applied state in which the all of the application liquid L adhering to the applying roller 1001 after slippery flowing out of the abutting member 2009 is transferred to the applying medium P. However, actually, not all of the application liquid L adhering to the applying roller 1001 is not transferred to the applying medium P. Specifically, when the applying medium P conveyed separates from the applying roller 1001, the application liquid L often also adheres to and remains on the applying roller 1001. The amount of application liquid L remaining on the applying roller 1001 varies depending on the material of the applying medium P or the state of fine concaves and convexes on the surface of the applying medium P. However, if the applying medium P is ordinary paper, the application liquid L remains on the peripheral surface of the applying roller 1001 after an applying operation.

Figure 24:
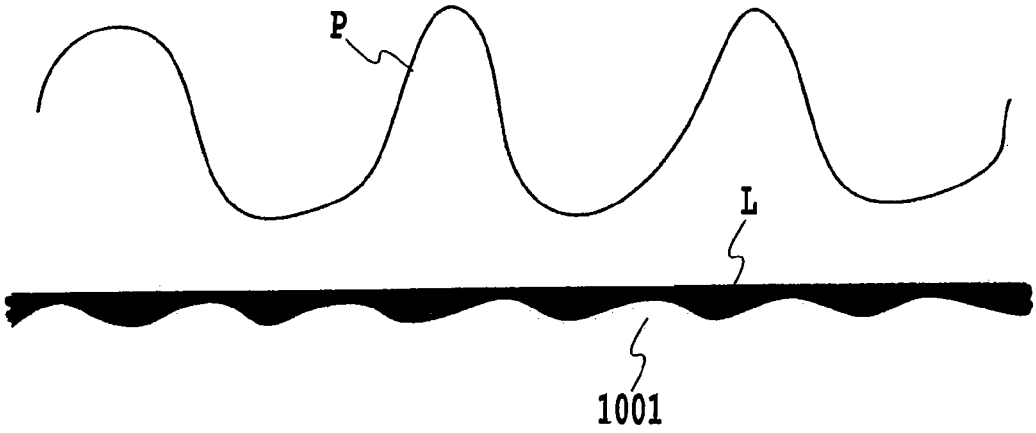
FIG. 24 is a diagram illustrating a applying process executed on a surface of a medium and a applying surface upstream of a nip portion between the applying roller and a counter roller if the medium is ordinary paper according to the embodiments of the present invention.
Figure 25:
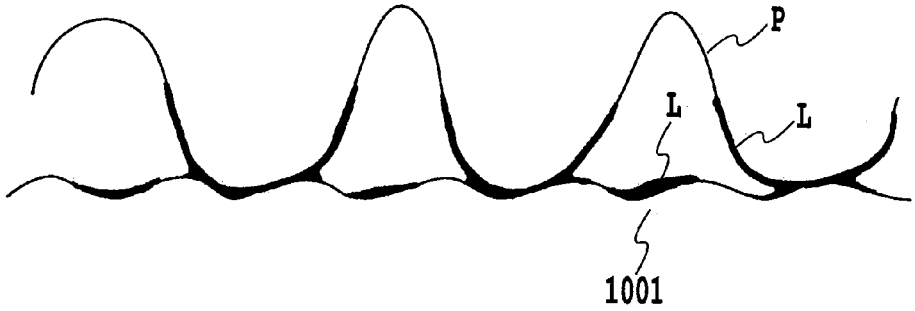
FIG. 25 is a diagram showing the state of the surface of the ordinary paper and the applying surface of the applying roller, at the nip portion between the applying roller and the counter roller.
Figure 26:
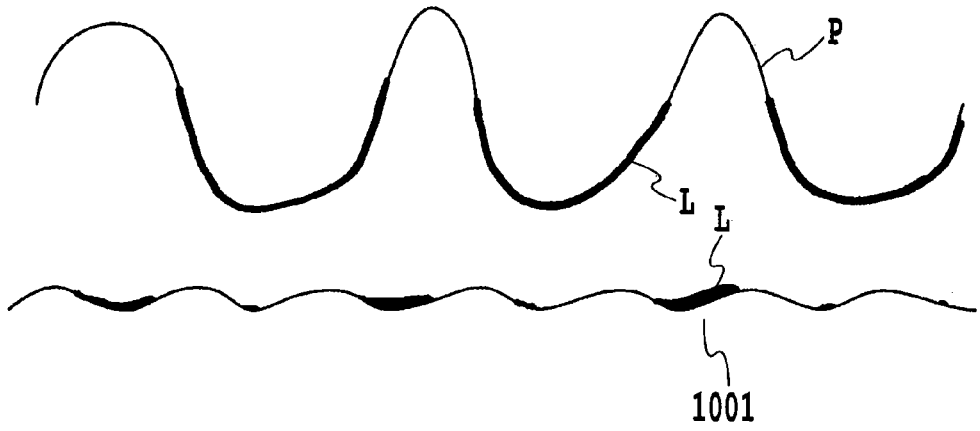
FIG. 26 is a diagram showing the state of the surface of the ordinary paper and the applying surface of the applying roller downstream of the nip portion between the applying roller and the counter roller.

FIGS. 24, 25, and 26 are diagrams illustrating the process of applying between a surface of the medium P and an applying surface in the case where the medium is ordinary paper. In these figures, the liquid is painted over with black.

FIG. 24 shows the state of the upstream side of the nip portion between the applying roller 1001 and the counter roller 1002. In this figure, the liquid adheres to the applying surf ace of the applying roller 1001 so as to slightly cover the fine concaves and convexes on the applying surf ace.

FIG. 25 shows the state of the surf ace of ordinary paper, the medium P, and the applying surf ace of the applying roller 1001, at the nip portion between the applying roller 1001 and the counter roller 1002. In this figure, the convexes on the surface of the ordinary paper, the medium P, contact with the applying surface of the applying roller 1001. The liquid instantaneously permeates through or sticks to fibers in the surface of the ordinary paper, the medium P, through the contacting parts. The liquid adhering to those parts of the applying surface of the applying roller which do not contact with the convex portions on the surface of the ordinary paper remains on the applying surface.

FIG. 26 shows the state of the downstream side of the nip portion between the applying roller 1001 and the counter roller 1002. In this figure, the medium has completely left the applying surface of the applying roller 1001. The liquid adhering to those parts of the applying surface of the applying roller 1001 which do not contact with the convex portions on the surface of the ordinary paper remains on the applying surface. The liquid on the contacting parts also remains with very small amount on the applying surface.

The application liquid remaining on the applying roller 1001 slippery flows between the applying roller 1001 and the upper edge 2010 of the abutting member 2009 and returns to the liquid holding space S, against the pushing force of the abutting member 2009 of the liquid holding member 2001, which force acts on the applying roller 1001. The application liquid is then mixed with the application liquid filled into the space S.

Figure 10:
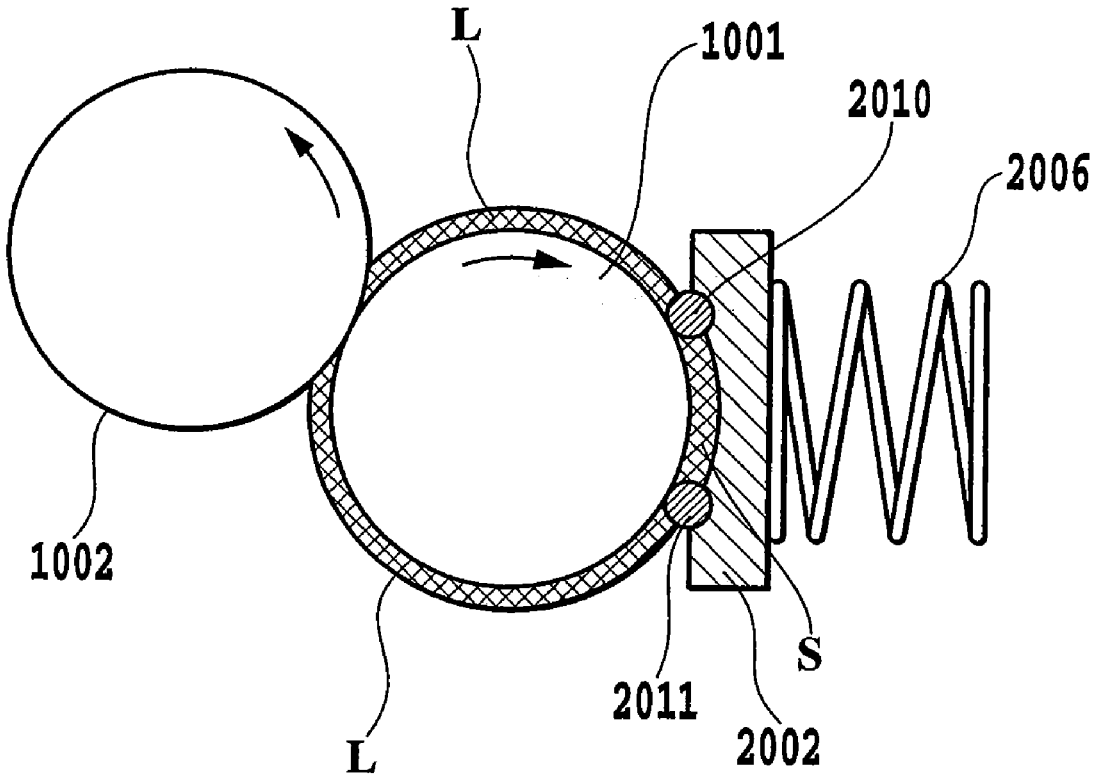
FIG. 10 is a vertical sectional view showing how the applying liquid is filled into the liquid holding space formed by the liquid holding member and the applying roller and how the applying roller is rotated when no applying medium is present.

The operation of returning the application liquid is similarly performed if the applying roller 1001 is rotated while no applying medium is present as shown in FIG. 10. That is, the application liquid adhering to the outer periphery of the applying roller 1001 as a result of the rotation of the applying roller 1001 slippery flows through the abutting portion between the applying roller 1001 and the counter roller 1002. After flowing through the abutting portion, the application liquid is separated into two parts directed to the applying roller 1001 and the counter roller 1002, respectively. The application liquid remains on the applying roller 1001. Then, the application liquid adhering to the applying roller 1001 slippery flows between the upper edge 2010 of the abutting member 2009 and the applying roller 1001 to enter the liquid holding spaces. The application liquid is then mixed with the application liquid filled into the space S.

Ending Step

Once the operation of applying the liquid to the applying medium has been performed as described above, the apparatus determines whether or not to finish the applying step. If the applying step is not to be finished, the process returns to step S5 to repeat the applying operation until the applying step is executed on the all the parts of the applying medium to which the liquid needs to be applied. When the applying step is finished, the applying roller 1001 is stopped (step S7). Moreover, the driving of the pump 3007 is stopped (step S8). Subsequently, the process shifts to step S2 to repeat the operations from step S2 to step S8 unless an applying start instruction is input before a predetermined period elapses. Even after the predetermined period has elapsed, if the applying start instruction is not input, a postprocess is executed such as a collecting operation of collecting the application liquid from the liquid holding space S and liquid channels (step S9). Then, the applying process is finished.

The collecting operation is performed by opening the air communicating valve 3005 and selector valve 3006 and driving the pump 3007 to cause the applying liquid in the applying liquid holding space S and second channel 3002 to flow into the liquid storing tank 3003. The collecting operation makes it possible to prevent the applying liquid from evaporating from the liquid holding space S. Further, after the collecting operation, the air communicating valve 3005 is closed and the selector valve 3006 is switched to block the communication between the liquid storing tank 3003 and both first channel 3001 and air communicating port 3013. The liquid storing tank 3003 is thus shut off from the air. Thus, the applying liquid can be prevented from evaporating from the liquid storing tank 3003. The applying liquid can also be prevented from flowing out even if the posture of the apparatus is tilted during movement, transportation, or the like.

As described above, in the liquid applying apparatus according to this embodiment, the rotation of the applying roller 1001 causes the applying liquid filled into the liquid holding space S to flow slipperily out of the liquid holding space S against the pressing force of the lower edge 2011 of the abutting member 2009 exerted on the applying roller 1001. The applying liquid is then supplied to the peripheral surface of the applying roller 1001 in layers. The thickness of the layers of the applying liquid, that is, the amount of applying liquid to be supplied to the applying roller 1001, depends on the viscosity of the applying liquid, the relative speed between the outer peripheral surface of the applying roller and the applying medium, and the pressing force of the abutting member exerted on the outer peripheral surface of the applying roller 1001.

Figure 14:
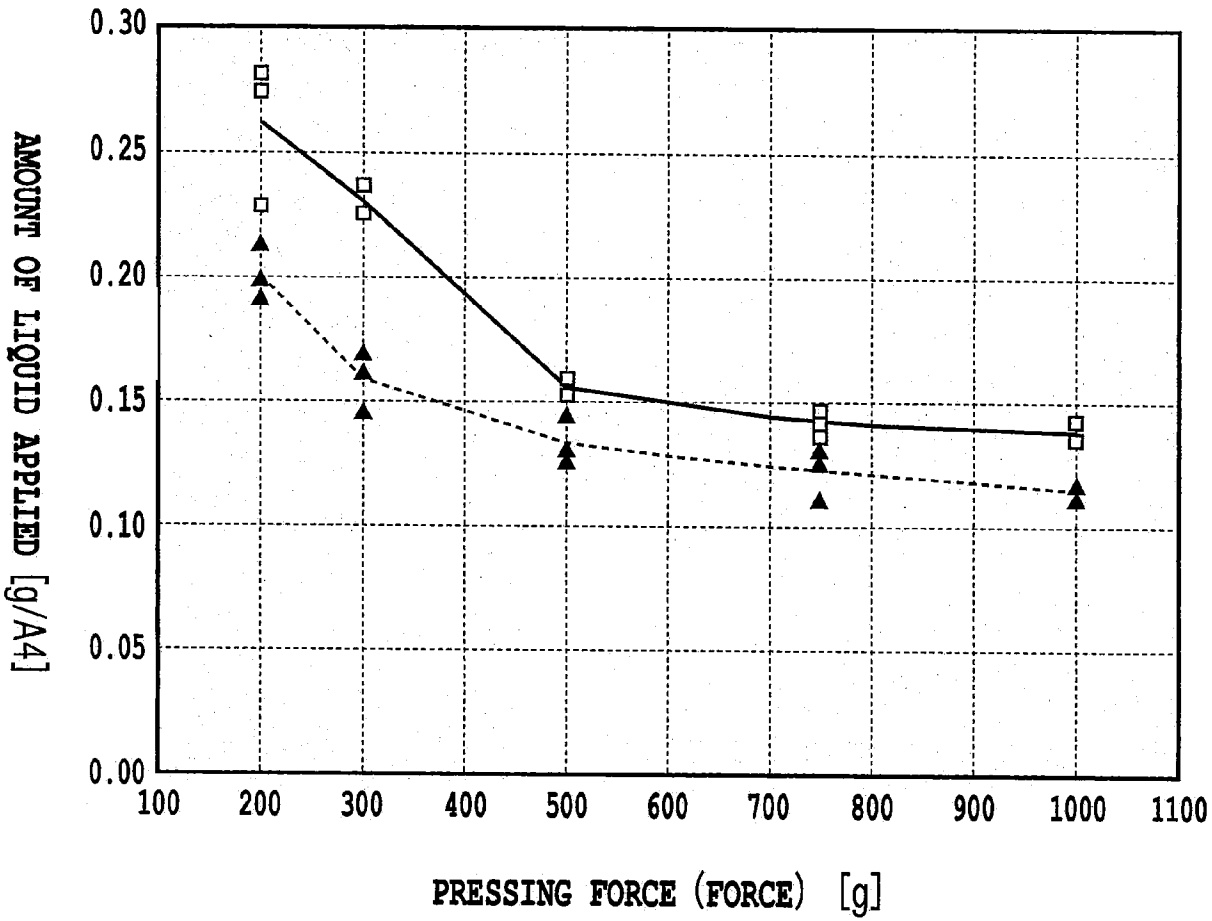
FIG. 14 is a graph showing the relationship between a pressing force exerted by an abutting member on the applying roller and the amount of applying liquid applied to the applying medium according to a first embodiment of the present invention.

FIG. 14 is a graph showing the measured amount of the above applying liquid applied to ordinary paper at 23° C. using the liquid applying apparatus according to this embodiment. In FIG. 14, the axis of abscissa indicates the total of forces of plural spring members 2006 used to allow the abutting member 2009 to exert the pressing force on the applying roller 1001. The axis of ordinate indicates the amount of applying liquid applied. Measured values shown by white squares indicate the amount of applying liquid applied when relative movement speed is set at 114 mm/sec. A continuous line in the figure is obtaining by joining the averages of measured values together, the measured values being obtained by measuring the amount of applying liquid applied, three times for each pressing force under the above speed condition. On the other hand, measured values shown by blackened triangles indicate the amount of applying liquid applied when the relative movement speed is set at 35 mm/sec. A dot line in the figure indicates the amount of applying liquid applied when the relative movement speed is set at 35 mm/sec. The dot line is also obtaining by joining the averages of measured values together, the measured values being obtained by measuring the amount of applying liquid applied, three times for each pressing force under the above speed condition.

As is apparent from the above graph, the stronger the pressing force of the abutting member 2009 exerted on the outer peripheral surface of the applying roller 1001, the smaller the thickness of the layer of the applying liquid flowing out slipperily from between the abutting member 2009 and the applying roller 1001. As a result, the amount of applying liquid applied decreases. On the other hand, the higher the relative speed, the larger the thickness of the layer of the applying liquid flowing out slipperily from between the abutting portions. As a result, the amount of applying liquid applied increases.

In this embodiment, foreign matter such as paper dust or dirt may be caught in the nip portion between the applying roller 1001 and the lower edge 2011 of the abutting member 2009, between the applying roller 1001 and the upper edge 2010 of the abutting member 2009. According to the present embodiment, a frictional force exerted between the applying roller 1001 and the foreign matter is stronger than that exerted between the abutting member 2009 and the foreign matter. Thus, the foreign matter moves together with the applying roller 1001 instead of remaining between the applying roller 1001 and the abutting member 2009. In contrast, if the frictional force exerted between the applying roller 1001 and the foreign matter is weaker than that exerted between the abutting member 2009 and the foreign matter, the foreign matter remains between the abutting member 2009 and the applying roller 1001. This may result in, for example, the nonuniform application of the applying liquid or the entry of air into the liquid holding space.

To set the frictional force exerted between the applying roller 1001 and the foreign matter stronger than that exerted between the abutting member 2009 and the foreign matter as described above, this embodiment sets the hardness of the applying roller 1001 lower than that of the lower edge 2011 or the upper edge 2010. Further, the abutting member 2009 is formed of a material that can slide more smoothly (that has a smaller coefficient of friction) than the applying roller 1001.

While the applying means of the present embodiment is carrying out applying, the applying liquid permeates through the abutting portion between the applying roller 1001 and the abutting member 2009 to function as a lubricant. Thus, the applying roller 1001 can slide more smoothly when rotated without any applying liquid than while carrying out applying. Even if the applying liquid is held in the liquid holding member, when the standing-by applying roller 1001, which is at a stop, is rotated, it can slide substantially as smoothly as when rotated without any applying liquid. The reason will be described below. Immediately after the applying roller 1001 has switched from the applying state to the stopped state, the applying liquid is present in the abutting portion between the applying roller 10014 and the abutting member 2009. However, as the time elapses, the applying liquid present in the abutting portion between the applying roller 1001 and the abutting member 2009 is pushed out of the abutting portion. The resulting state is comparable to that observed when the applying roller 1001 is rotated without any applying liquid.

If the applying roller cannot slide smoothly when rotated as described above, loads on a motor that is the driving source of the applying roller 1001 increase. It is thus necessary to use a large-scale motor or increase power consumption.

It is therefore desirable to allow the applying roller 1001 to slide smoothly over the abutting member 2009 even without any applying liquid. Thus, the applying roller 1001 was experimentally made using the materials listed below. Experiments were made for the slidability of the applying roller 1001 on the abutting member 2009.

Material 1: EPDM of rubber hardness 30°

Material 2: EPDM of rubber hardness 50°

Material 3: EPDM of rubber hardness 70°

Material 4: NBR (type A) of rubber hardness 30° (vulcanizing cross-linked)

Material 5: NBR (type B) of rubber hardness 40° (peroxide cross-linked)

Material 6: Silicon rubber (type A) of rubber hardness 40°

Material 7: Silicon rubber (type A) of rubber hardness 70°

Material 8: Silicon rubber (type B) of rubber hardness 50°

Material 9: Silicon rubber (type B) of rubber hardness 70°

Both materials 4 and 5 are NBR but are formed of different rubber materials. All materials 6, 7, 8, and 9 are silicon rubber but have different grades.

Figure 27:
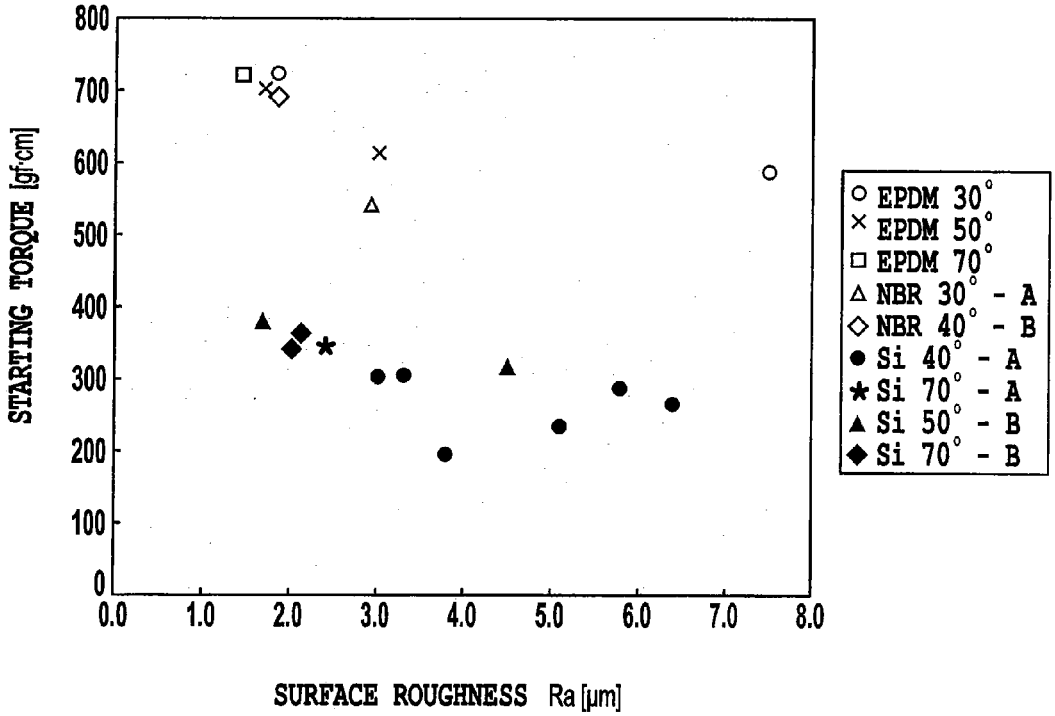
FIG. 27 is a graph showing measured values of a load torque applied to a driving shaft of a motor when rotation is started, each value being measured with a condition that the applying roller is composed of a different material.

FIG. 27 shows measurements of a load torque applied to the driving shaft of the motor when it starts to rotate (starting torque); in this case, the abutting member 2009 was formed of EPDM of rubber hardness 35° and the applying roller 1001 was composed of each of the above materials. The abutting member 2009 was pressed against the applying roller 1001 at a total pressure of 600 gf.

In the graph in FIG. 27, the axis of abscissa indicates the measured values of the surface roughness of the applying surface of the applying roller 1001. The axis of ordinate indicates the measured values of the load torque applied to the driving shaft of the motor when it starts to rotate. In the graph in FIG. 27, materials 1, 2, and 3 are denoted by ○, x, and □. Materials 4, 5, and 6 are denoted by Δ, ◇, and ●. Materials 7, 8, and 9 are denoted by ✱, ▲, and ◆.

FIG. 27 indicates that a lower torque is applied to the applying rollers composed of materials 6 to 9 than to the applying rollers composed of materials 1 to 5 when they start to rotate. This indicates that silicon rubber is an appropriate material for the applying roller 1001.

Figure 28:
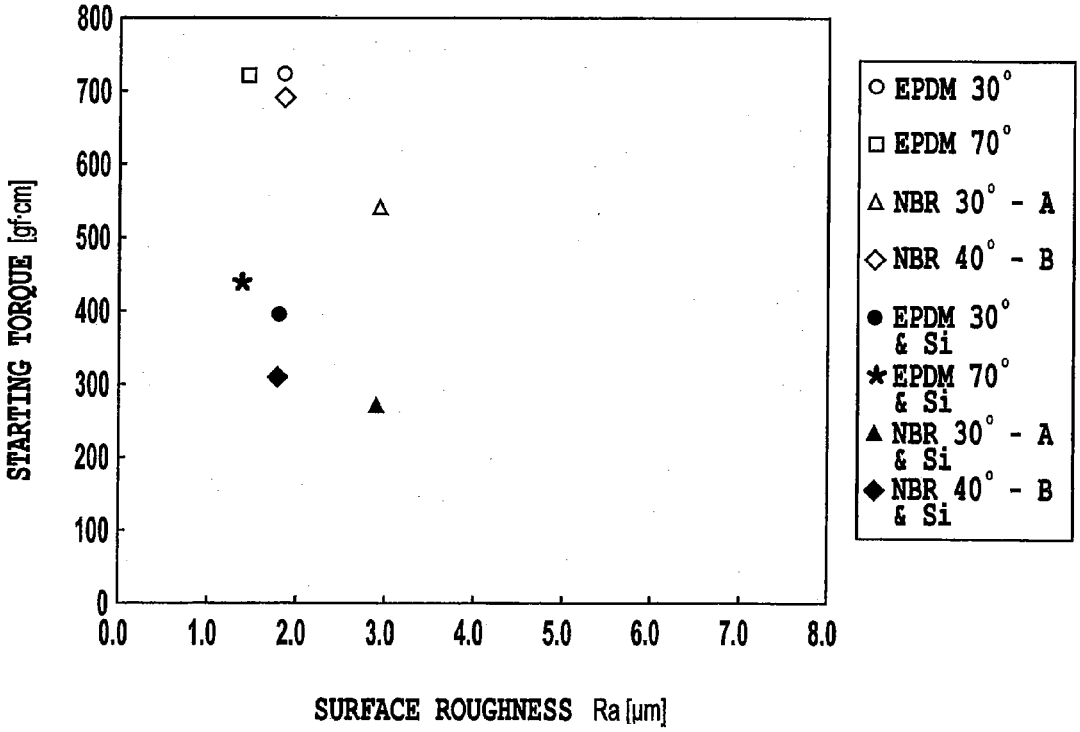
FIG. 28 is a graph showing measured values of the load torque applied to the driving shaft of the motor when rotation is started, each value being measured with a condition that the abutting member is composed of a different material.

FIG. 28 shows measurements of the load torque applied to the driving shaft of the motor when it starts to rotate (starting torque); in this case, the abutting member 2009 was composed of material 1, 3, 4, or 5, which does not allow the applying roller 1001 to slide smoothly. Experiments were made by forming different abutting members 2009 using EPDM of rubber hardness 35° and silicon rubber of rubber hardness 30°. In this case, the abutting member 2009 was also pressed against the applying roller 1001 at a total pressure of 600 gf.

In the graph in FIG. 28, the axis of abscissa indicates the measured values of the surface roughness of the applying surface of the applying roller 1001. The axis of ordinate indicates the measured values of the load torque applied to the driving shaft of the motor when it starts to rotate (starting torque). In the graph in FIG. 28, ○, □, Δ, and ◇ denote the measured values obtained when the abutting member 2009 was composed of EPDM of rubber hardness 35° and when the applying roller 1001 was formed of materials 1, 3, 4, and 5, respectively. Further, ●, ✱, ▲, and ◆ denote the measured values obtained when the abutting member 2009 was composed of silicon rubber of rubber hardness 30° and when the applying roller 1001 was formed of materials 1, 3, 4, and 5, respectively.

FIG. 28 indicates that a lower torque is applied to the applying roller when it starts to rotate if the abutting member 2009 is formed of silicon rubber than if the abutting member 2009 is formed of EPDM.

The above results indicate that the slidability of the applying roller 1001 upon rotation can be improved by forming at least one of the applying roller 1001 and abutting member 2009 using silicon rubber.

Second Embodiment

Now, with reference to FIG. 15, description will be given of an essential part of a second embodiment of the present invention.

According to the second embodiment, the applying member that applies the applying liquid to the applying medium is composed of the applying roller 1001, the counter roller 1002, and the intermediate roller 1006. The abutting member 2009 of the liquid holding member 2001 configured as in the case of the first embodiment is abutted against the applying roller 1001 under the pressing force of the spring member 2006. A liquid holding space S is thus formed between the intermediate roller 1006 and the applying member.

In this case, the applying roller 1001 and the counter roller 1002 are composed of a material similar to that used in the first embodiment. The intermediate roller 1006 is composed of the same material as that of the applying roller 1001 and has the same diameter as that of the roller 1001. Further, the intermediate roller 1006 rotates in synchronism with the applying roller 1001 at the same rotation speed. The intermediate roller 1006 can be rotated using the driving force of the roller driving motor 1004 (see FIG. 1), which rotates the applying roller 1001. A motor dedicated for the intermediate roller 1006 can also be used. The remaining part of the configuration is similar to that of the above embodiment. In the relevant drawings, parts identical or corresponding to those of the first embodiment are denoted by the same reference numerals.

In the second embodiment configured as described above, the applying liquid from a liquid supplying channel 3000 (see FIG. 11) connected to the liquid holding member 2001 is supplied to and filled into the liquid holding space S, formed between the liquid holding member 2001 and the intermediate roller 1006. While the intermediate roller 1006 is at a stop, the liquid holding space S is kept liquid-tight to prevent leakage from it.

Figure 15:
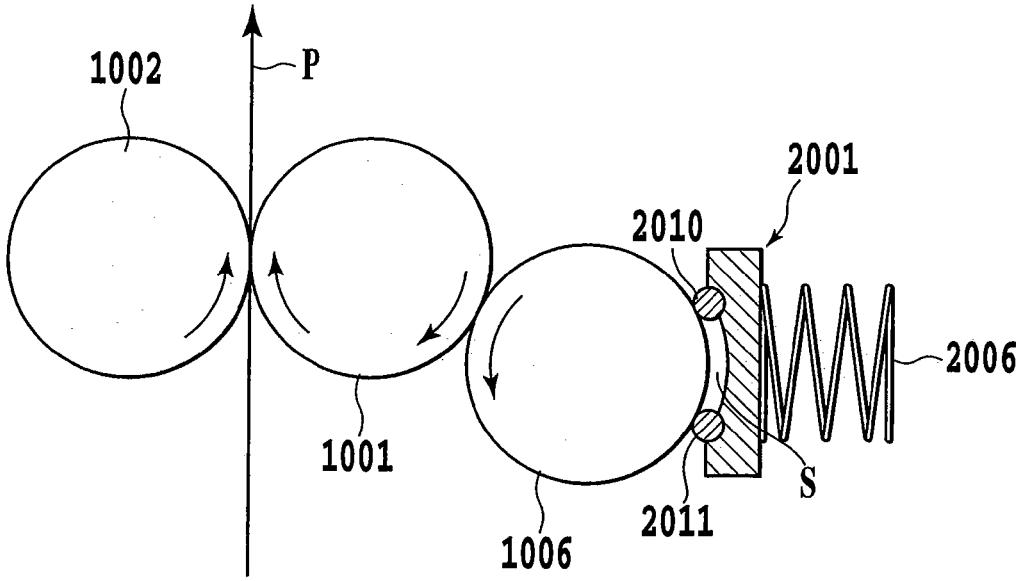
FIG. 15 is a vertical side view showing an essential part of a second embodiment of the present invention.
Figure 16:
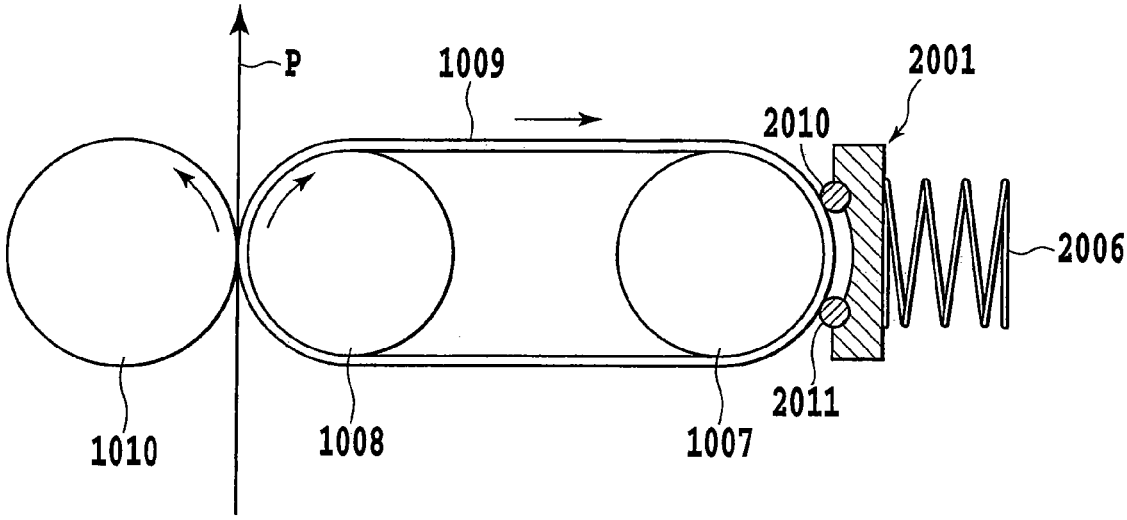
FIG. 16 is a vertical side view showing an essential part of a third embodiment of the present invention.

During an applying operation, the applying roller 1001 and the intermediate roller 1006 start to rotate in synchronism in opposite directions as shown by arrows in FIG. 15. The intermediate roller 1006 rotates to cause the applying liquid to flow slipperily out of the liquid holding space S against the pressing force of the abutting member 2009 exerted on the intermediate roller 1006. The applying liquid is then supplied to the peripheral surface of the intermediate roller 1006 in layers. Subsequently, the applying liquid supplied to the intermediate roller 1006 is transferred to a position at which the intermediate roller 1001 abuts against the applying roller 1001. At this position, the applying liquid adheres to the applying roller in layers. According to this embodiment, the applying roller 1001 and the intermediate roller 1006 are formed of the same material so as to have the same surface structure. Further, the surface energy of both rollers is set at substantially the same value. The applying liquid supplied to between the rollers is substantially uniformly divided to the applying roller 1001 and to the intermediate roller 1006. That is, the applying roller 1001 is supplied with the applying liquid the amount of which is about half that of applying liquid supplied to the outer peripheral surface of the intermediate roller 1006 in layers. Then, the applying liquid supplied to the applying roller 1001 is applied to one surface of the applying medium P fed upward in the figure to between the applying roller 1001 and the counter roller 1002. After passing through the abutting position between the applying roller and the intermediate roller, an amount of applying liquid remains on the intermediate roller. This applying amount is then returned to the liquid holding space S through the lower edge of the abutting member 2009.

Thus, the applying liquid supplied to the applying roller 1001 is divided at the abutting position between the intermediate roller 1006 and the applying roller 1001. This makes it possible to limit the amount of applying liquid supplied to the applying roller 1001. In other words, it is possible to supply a reduced amount of applying liquid to the applying medium P compared to the direct applying, from the liquid holding space S, of the applying liquid to be applied to the applying roller 1001. Therefore, the present embodiment is effective if a small amount of applying liquid is to be supplied to the applying medium.

Third Embodiment

Now, with reference to FIG. 18, description will be given of an essential part of a third embodiment of the present invention.

In the above description of the first and second embodiments, by way of example, the applying roller 1001 constitutes the applying member that applies the liquid to the applying medium. According to the third embodiment, the applying member is constructed by extending an endless belt 1009 around two rollers 1007 and 1008 instead of the applying roller 1001 and disposing a counter roller 1010 that sandwiches the belt 1009 between itself and the roller 1008.

On the other hand, the liquid holding member 2001 is configured as shown in the above embodiments. The abutting member 2009 of the liquid holding member 2001 abuts against the roller 1007 under the pressing force of the spring member 2006 at a position where it is opposite the roller 1007. An outer surface of the endless belt 1009 desirably has surface energy higher than that of the counter roller 1010. Additionally, for example, the liquid channel through which the applying liquid is supplied to the liquid holding space S is similar to that of the above embodiments.

In the third embodiment, while the belt 1009 is at a stop, the liquid holding space S maintains a liquid-tight state between the abutting member 2009 and the endless belt 1009. This prevents the liquid from leaking from the liquid holding space S. Further, during a liquid applying operation, the roller 1008 is rotated by the driving force of the motor or the like to circulate the endless belt 1009 in a direction shown by an arrow in the figure. The circulatory movement of the belt 1009 causes the applying liquid in the applying liquid holding space S to flow slipperily across the abutting position between the endless belt 1009 and the abutting member 2009. The applying liquid then adheres, in layers, to the endless belt having passed through the liquid holding space S.

The applying liquid adhering to the endless belt 1009 reaches the abutting position between the endless belt 1009 and the counter roller 1010. The applying liquid is then applied to one surface of the applying medium P fed downward in the figure to the abutting position. When the endless belt 1009 is separated from the applying medium P, an amount of applying liquid remains on the endless belt 1009. This applying liquid is returned to the applying space S through between the endless belt 1009 and the lower edge 2011 of the abutting member 2009.

As described above, according to the third embodiment, the belt 1009 is used to apply the applying liquid to the applying medium P. The third embodiment is thus effective if for example, it is necessary to set a large distance or spacing between the liquid holding member 2001 and a position where the applying member applies the liquid to the applying medium P. In other words, whatever distance or spacing there is between the liquid holding member 2001 and the path through which the applying medium is moved, the liquid can basically be applied using three members including the two rollers 1007 and 1008 and the endless belt 1009. In addition to the two rollers, one or more idler rollers may be contacted with the endless belt 1009 so that its position is adjustable. Thus, even if the distance or spacing between the two rollers is set at various values, a constant tension can always be applied to the endless belt by adjusting the positions of the idlers rollers.

Fourth Embodiment

Figure 17:
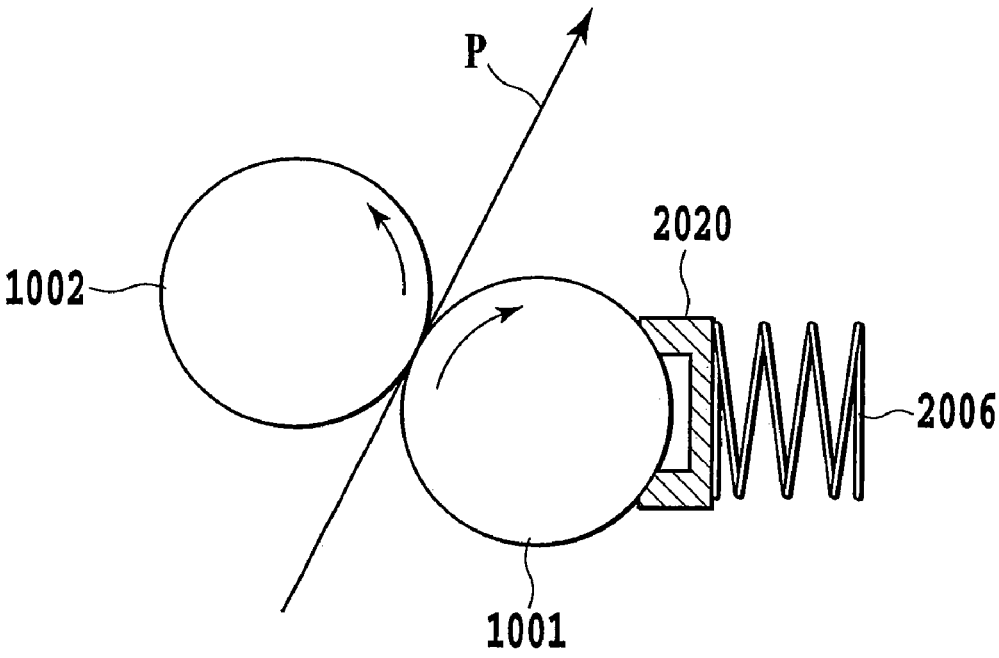
FIG. 17 is a vertical side view showing an essential part of a fourth embodiment of the present invention.

Now, with reference to FIGS. 17 to 19, description will be given of an essential part of a fourth embodiment of the present invention.

In the description of the first embodiment, by way of example, the liquid holding member 2001, cooperating with the applying roller 1001 in forming the liquid holding space S, is constructed by fastening the abutting member 2009 to the space forming base material 2002 using an adhesive or the like, the abutting member 2009 being separate from the base material 2002. In contrast, the elements of a liquid holding member 2020 according to the fourth embodiment are integrally formed of the same member.

Figure 18:
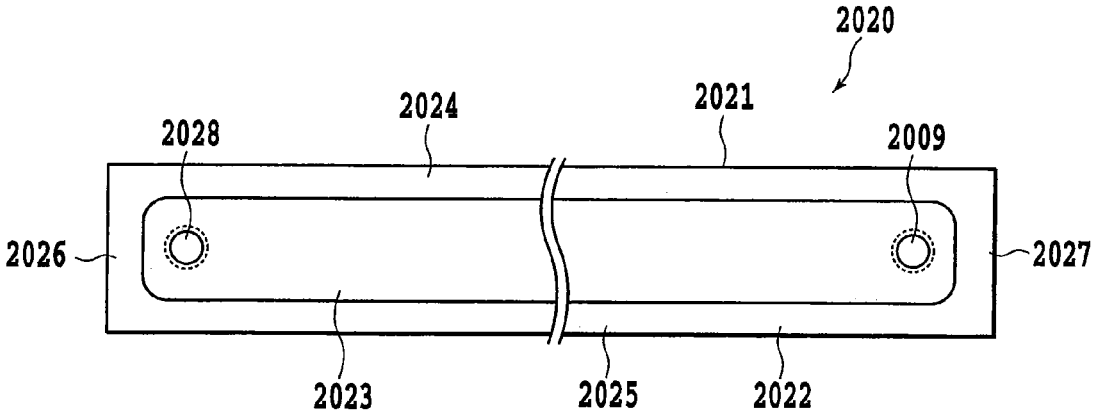
FIG. 18 is a partly cutaway front view of the liquid holding member shown in FIG. 17.

Specifically, the liquid holding member 2020 is shaped by using a resin such as acrylic to integrally mold a space forming base material 2021 formed like a plate and having a rectangular front shape and an abutting portion 2022 formed like a rectangular ring and projecting along a peripheral portion of the space forming base material 2021 as shown in FIG. 18. Thus, the liquid holding member 2020 has a concave portion 2023 formed by the space forming base material 2012 and the abutting portion 2022 as shown in FIG. 19. The abutting portion 2022 has an upper edge 2024 extending along a direction parallel to that of a central axis of the applying roller 1001, a lower edge 2025 parallel to the upper edge 2024, and a left and right side edges 2026 and 2027 connecting the upper edge 2024 and the lower edge 2025 together. End surfaces of the upper edge 2024 and lower edge 2025, that is, the surfaces abutting against the applying roller 1001, are formed, from their outer edges to inner edges, like circular arcs conforming to the outer peripheral surface of the applying roller 1001 as shown in FIG. 17. Further, the side edges are also formed, from their upper edges to lower edges, like circular arcs conforming to the outer peripheral surface of the applying roller 1001 as shown in FIG. 19.

Moreover, a liquid supplying port 2028 and a liquid recovering port 2029 are formed near opposite ends of a concave portion 2023 in the space forming base material 2021. Cylindrical connecting portions 2028 and 2029 are projected from the liquid supplying port 2028 and liquid recovering port 2029 for connection to the liquid channel. These connecting portions are integrally formed similarly to the other portions. The upper edge 2024, the lower edge 2025, and the left and right side edges 2026 and 2027 have their abutting surfaces roughened using file No. 500 so that the applying liquid permeates appropriately through the abutting surfaces.

On the other hand, desirably, the material and hardness of the applying roller 1001 are properly determined in accordance with the material of the liquid holding member 2020. For example, if the liquid holding member 2020 is formed of acrylic, the applying roller 2001 may be formed of aluminum, while the counter roller 3001 may be formed of EPDM. Further, the EPDM has a rubber hardness of 50°.

By abutting the liquid holding member 2020 configured as described above, against the outer peripheral surface of the applying roller 1001 using the spring member 2006 as in the case of the first embodiment, it is possible to reliably prevent the liquid from leaking from the liquid holding space S as a result of the abutment between the applying roller 1001 and the abutting member 2009 while the applying roller 1001 is at a stop. On the other hand, while the applying roller 1001 is rotating, the applying liquid can be supplied to the peripheral surface of the applying roller 1001 in layers against the pressing force of the abutting member 2020 exerted on the applying roller 1001 as in the case of the first embodiment. Furthermore, in the fourth embodiment, the liquid holding member 2020 is integrally molded of the single member. Consequently, the fourth embodiment is expected to produce a liquid leakage prevention effect superior to that produced in the case of the sticking of the separate member. Further, manufacturing costs can be sharply reduced.

Description will be given below of a preprocess liquid supplying means according to the fourth embodiment of the present invention.

Figure 33:
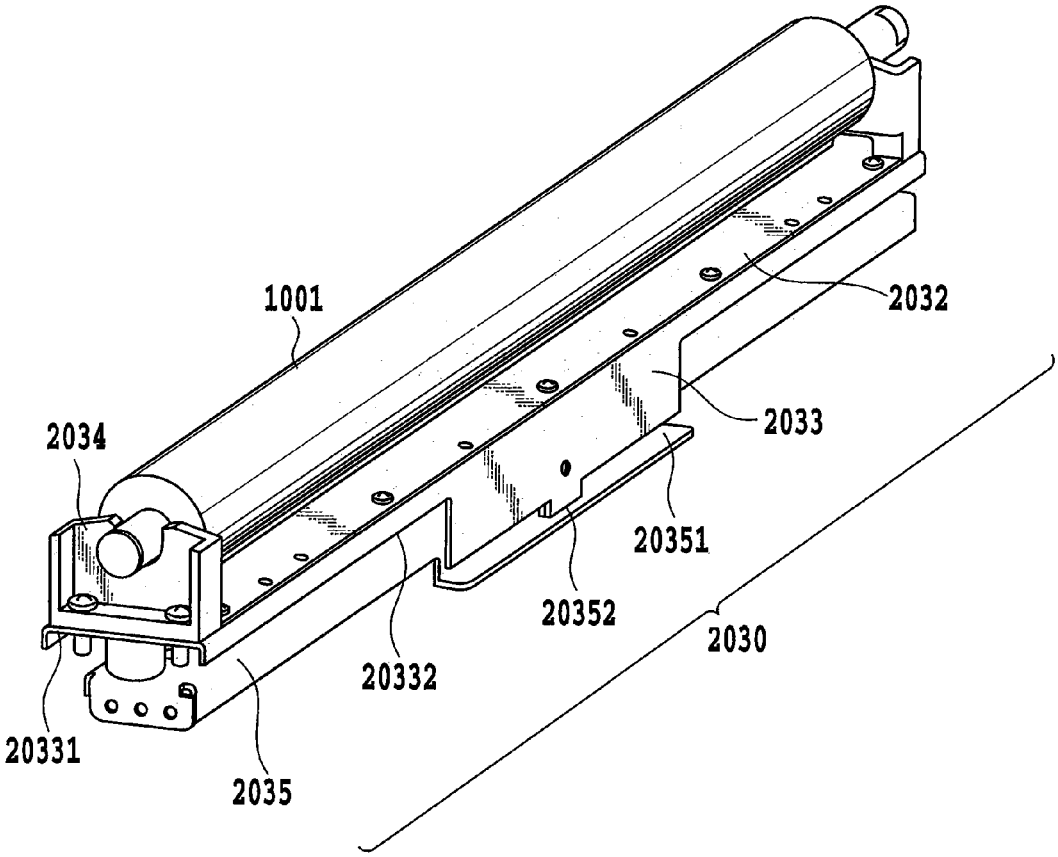
FIG. 33 is a perspective view showing an applying roller and liquid applying means according to a fourth embodiment.

FIG. 33 is a perspective view showing an embodiment of the preprocess liquid supplying means according to the present invention. The applying liquid supplying means has a liquid holding mechanism 2030 that holds the applying liquid between itself and the peripheral surface of the cylindrical applying roller 1001 which is composed of an elastic member such as rubber and which applies the liquid to the medium and a liquid channel through which the liquid is supplied to the liquid holding mechanism 2030. The liquid holding mechanism 2030 extends almost all over the applying roller 1001 in its longitudinal direction. The liquid holding mechanism 2030 is attached to the applying roller 1001 via a mechanism that enables it to be contacted with and separated from the peripheral surface of the applying roller 1001.

Figure 34:
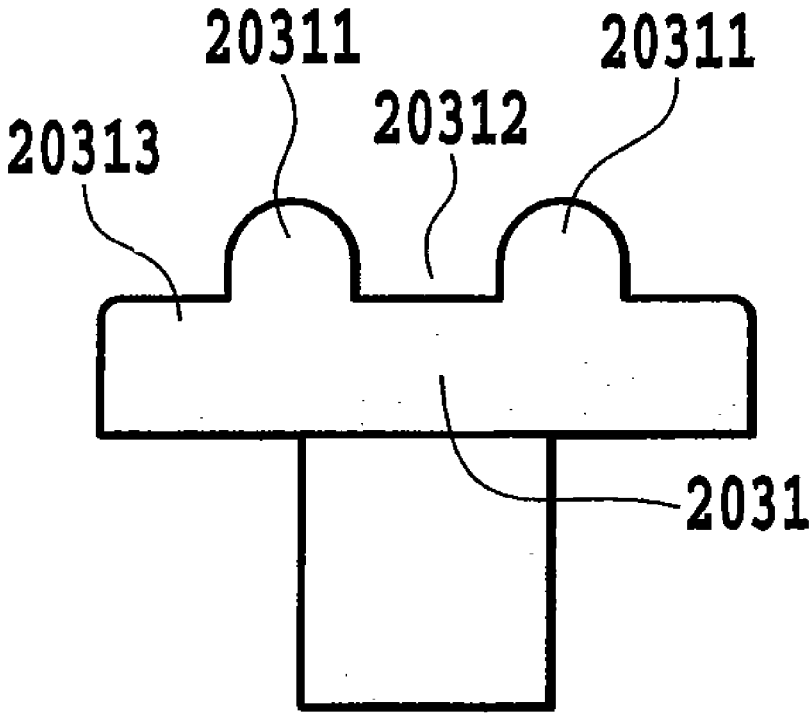
FIG. 34 is a sectional view of a liquid holding member shown in FIG. 33.
Figure 35:
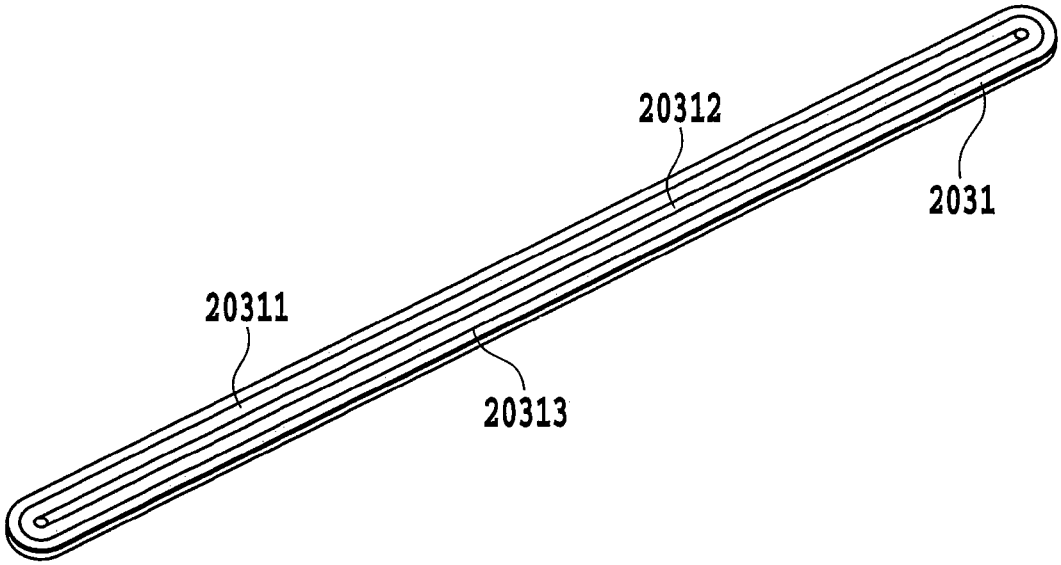
FIG. 35 is a sectional view of the liquid holding member shown in FIG. 33.
Figure 36:
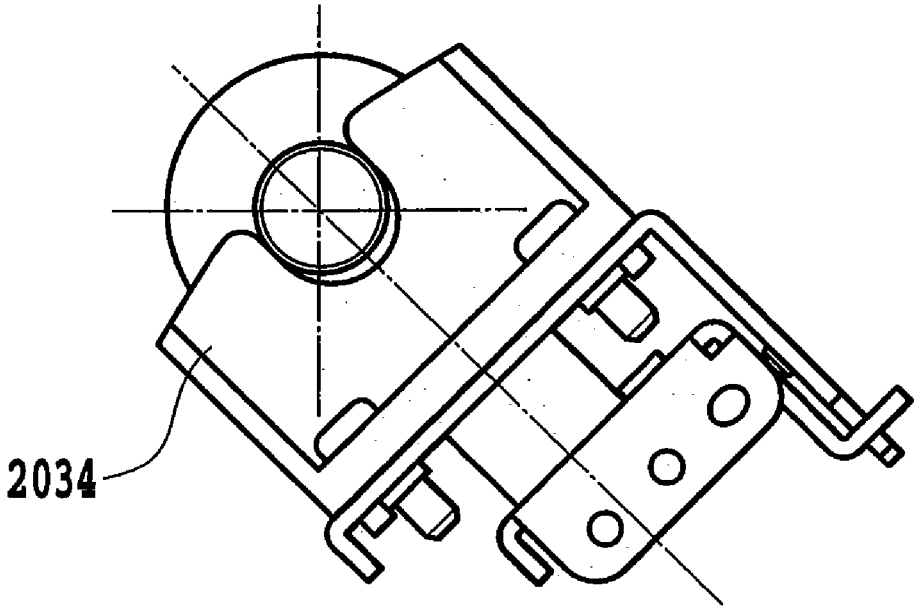
FIG. 36 is a side view of a liquid holding mechanism shown in FIG. 33.
Figure 37:
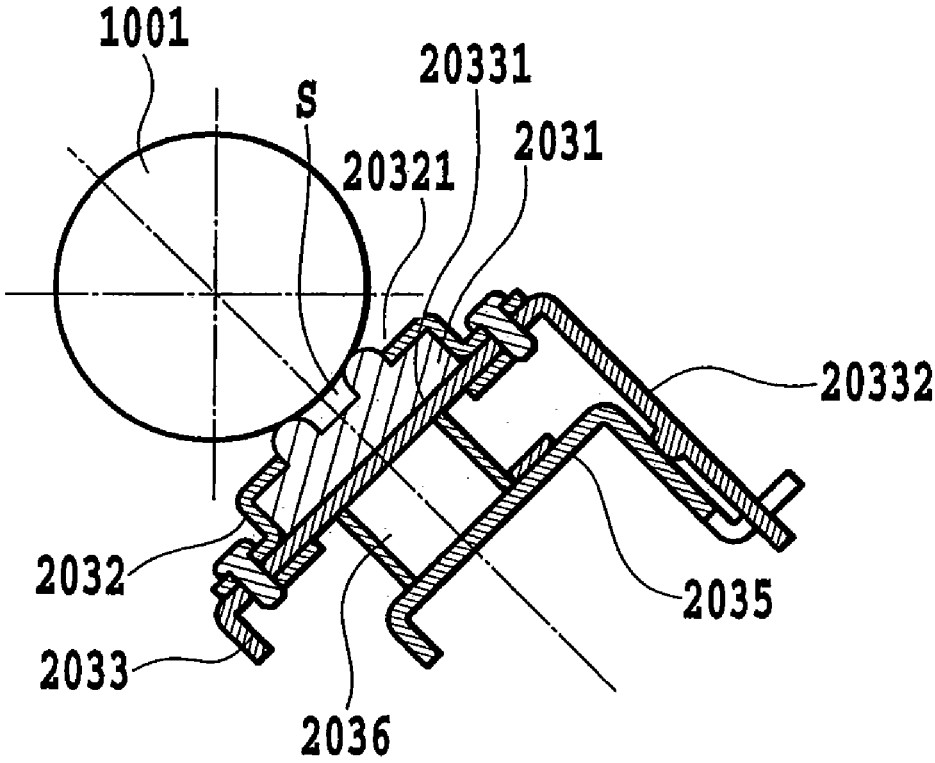
FIG. 37 is a side view of the liquid holding mechanism shown in FIG. 33.

The liquid holding mechanism 2030 will be described with reference to FIGS. 33 to 37. FIGS. 34 and 35 are a sectional view and a perspective view, respectively, of the liquid holding mechanism 2031. FIGS. 36 and 37 are a side view and a sectional view of the liquid holding mechanism 2030.

In FIGS. 33 to 35, reference numeral 2031 denotes a liquid holding member composed of an elastic member such as rubber and having two projecting portions 20311 along its longitudinal direction, a liquid holding space 20312 between the projecting portions, and a flange portion 20313. The liquid holding portion 2031 is also characterized by being formed integrally and seamlessly. Reference numeral 2033 denotes a holding member that holds the liquid holding member 2031. The holding member 2033 is composed of a flat surface 20331 on which the liquid holding member 2031 is held and a guide portion 20332 extending perpendicularly to the flat surface 20331. Reference numeral 2032 denotes a stopper that stops the liquid holding member. As shown in FIG. 35, the liquid holding member 2031 is fixedly positioned on the flat surface 20331 of the holding member 2033. In this case, the positioning is accomplished by fitting the projecting portions 20311 of the liquid holding member 2031 into holes 20321 in the stopper 2032. Subsequently, the stopper 2032 is fixed to the holding member 2033 using screws. Reference numeral 2034 denotes guides that allow the liquid holding member 2031 to abut on a normal of the applying roller 1001. The guide 2034 is fixed to opposite ends of the flat surface 20331 of the holding member 2033. Reference numeral 2035 denotes a pedestal fixed to a fixing member such as a frame, parallel to the central axis of the applying roller.

This configuration allows the liquid holding member 2031, the stopper 2032, and the pedestal 2033 to operate integrally. The liquid holding member 2031, the stopper 2032, and the pedestal 2033 can be guided to guide holes 20352 formed in the right and left guides 2034 and in a positioning portion 20351 of the pedestal 2035. The liquid holding member 2031, the stopper 2032, and the pedestal 2033 can then be slid in the normal direction of the applying roller 1001. Reference numeral 2036 denotes a spring member mounted on the pedestal 2035 to urge the holding member 2033 from its rear surface to bring the holding member 2031 into pressure contact with the applying roller 1001.

With the applying liquid holding mechanism 2030 according to the present embodiment, the liquid holding member 2031 abuts tightly against the outer peripheral surface of the applying roller along the upper edges 20311 of ribs of the liquid holding member 2031. As a result, the liquid holding member 2031 forms an elongate liquid holding space S extending all over an area to which the applying liquid is applied by the applying roller 1001. The applying liquid from the liquid supplying path, described later, is supplied to the interior of the liquid holding space S via the liquid holding member 2030.

According to the present embodiment, the applying roller 1001 is formed of silicon and has a surface roughness Ra of 1.8 and a diameter of 23.169 mm. The liquid holding member 2031 is formed of EPDM having a rubber hardness of 50°. Further, according to the present embodiment, for the two projecting portions 20311 of the liquid holding member 2031, the abutting surface located downstream of the applying roller 1001 is below the one located upstream of the applying roller 1001. Furthermore, the applying roller 1001 and the liquid holding member 2031 are arranged at positions such that the midpoint between the two projecting portions of the liquid holding member 2031 lies on a straight line inclined at 45° from a horizontal line passing through the rotational center of the applying member.

When the liquid holding member 2031 according to the present embodiment was used and the pressing force exerted by the spring member 2036 on the liquid holding member was set at 2,000 gf, about 0.15 g of applying liquid was able to be applied to A4-sized ordinary paper.

Another Embodiment

In the above embodiments, the amount of liquid to be applied to the applying medium can be changed by changing the pressing force of the liquid holding member exerted on the coating roller, the pressing force changed by changing the magnitude of the elastic force of the spring member.

Moreover, the amount of liquid to be applied can be changed by changing the hardness of the liquid holding member and of the applying roller or a roller supporting the endless belt.

Further, in the above embodiments, the use of the coil spring serving as a spring member is shown as pressing means for pressing the liquid holding member against the applying roller. However, another spring, for example, a plate spring, can also be used. Moreover, an elastic member such as rubber can be used in place of the spring member.

According to the present invention, the positions where the liquid supplying port and the liquid collecting port are formed in the liquid holding member as well as the numbers of liquid supplying and collecting ports are not limited to those in the above embodiments. For example, it is possible to arrange the liquid supplying ports at the opposite ends of the liquid holding space, while forming one or more liquid collecting ports between these liquid supplying ports. Conversely, it is possible to arrange the liquid collecting ports at the opposite ends of the liquid holding space, while forming one or more liquid supplying ports between these liquid supplying ports. In short, the liquid held in the liquid supplying member has only to be able to flow through the liquid holding space.

In the above embodiments, the counter roller is provided opposite the applying roller or endless belt. However, a support member such as a plate material may be provided in place of the counter roller so that the applying member is sandwiched between the plate material and the applying roller. Then, the moving force of the applying roller or endless belt may be transmitted to the applying medium. In this case, a surface of the support member which contacts with the applying medium must have a small coefficient of friction and a low surface energy.

Embodiment of an Ink Jet Printing Apparatus

Figure 20:
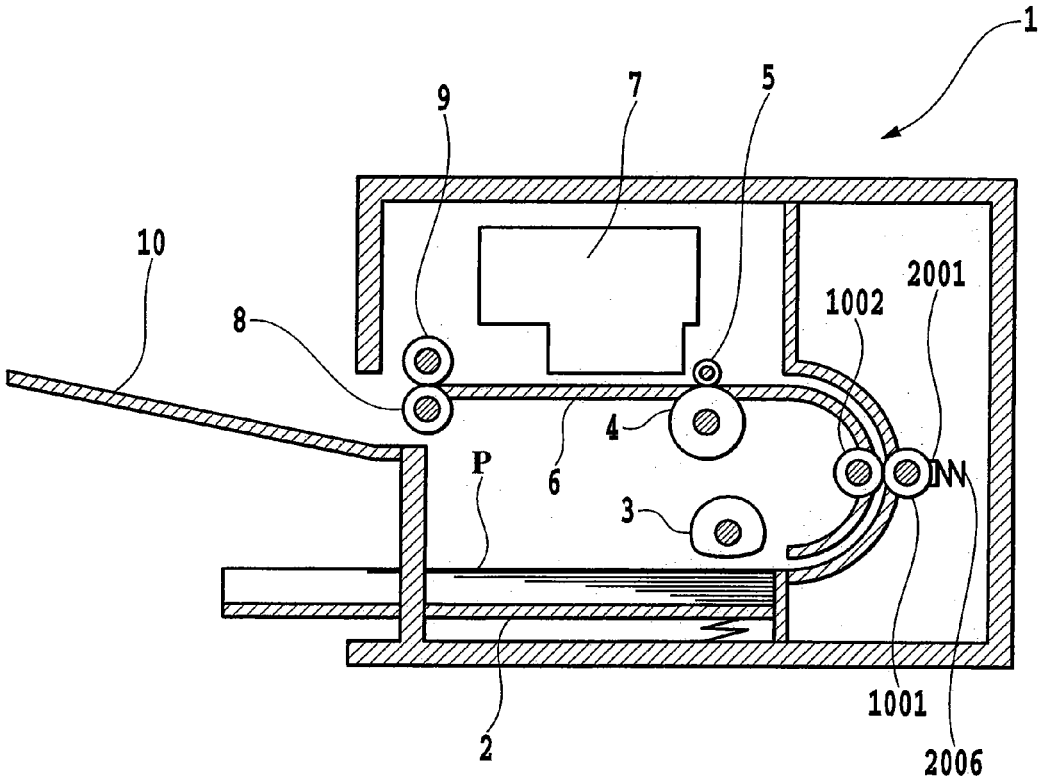
FIG. 20 is a vertical side view generally showing the configuration of an ink jet printing apparatus according to the embodiment of the present invention.

FIG. 20 is a diagram generally showing the configuration of an ink jet printing apparatus 1 comprising an applying mechanism having almost the same configuration as that of the above liquid applying apparatus.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute liquid applying means of the liquid applying mechanism. The print medium P fed by the feeding tray 2 is then fed to between the rollers 1001 and 1002. The applying roller 1001 is rotated clockwise in FIG. 20 by the rotation of a roller driving motor. The applying roller 1001 applies the application liquid to a print surface of the print medium P while conveying the print medium P. The print medium P to which the application liquid has been applied is fed to between a conveying roller 4 and a pinch roller 5. Then, the conveying roller 4 is rotated counterclockwise in the figure to convey the print medium P on a platen 6. The print medium P then moves to a position opposite to a print head 7 constituting printing means. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

As this ink jet printing apparatus, what is called a full line type can be constructed in which an elongate print head having nozzles from which inks are ejected and which are disposed over the maximum width of the print medium is used to perform a printing operation.

The application liquid used in the present embodiment is a treatment liquid that facilitates the coagulation of pigments when inks composed of the pigments as color materials are used for printing.

In the present embodiment, the treatment liquid is used as an application liquid to react with the pigments, which are the color materials of the inks ejected to the print medium to which the treatment liquid has been applied. This facilitates the coagulation of the pigments. The facilitation of the coagulation of the pigments improves the printing density. Moreover, it is possible to suppress or prevent bleeding. The application liquid used in the ink jet printing apparatus is not limited to the above example.

Figure 21:
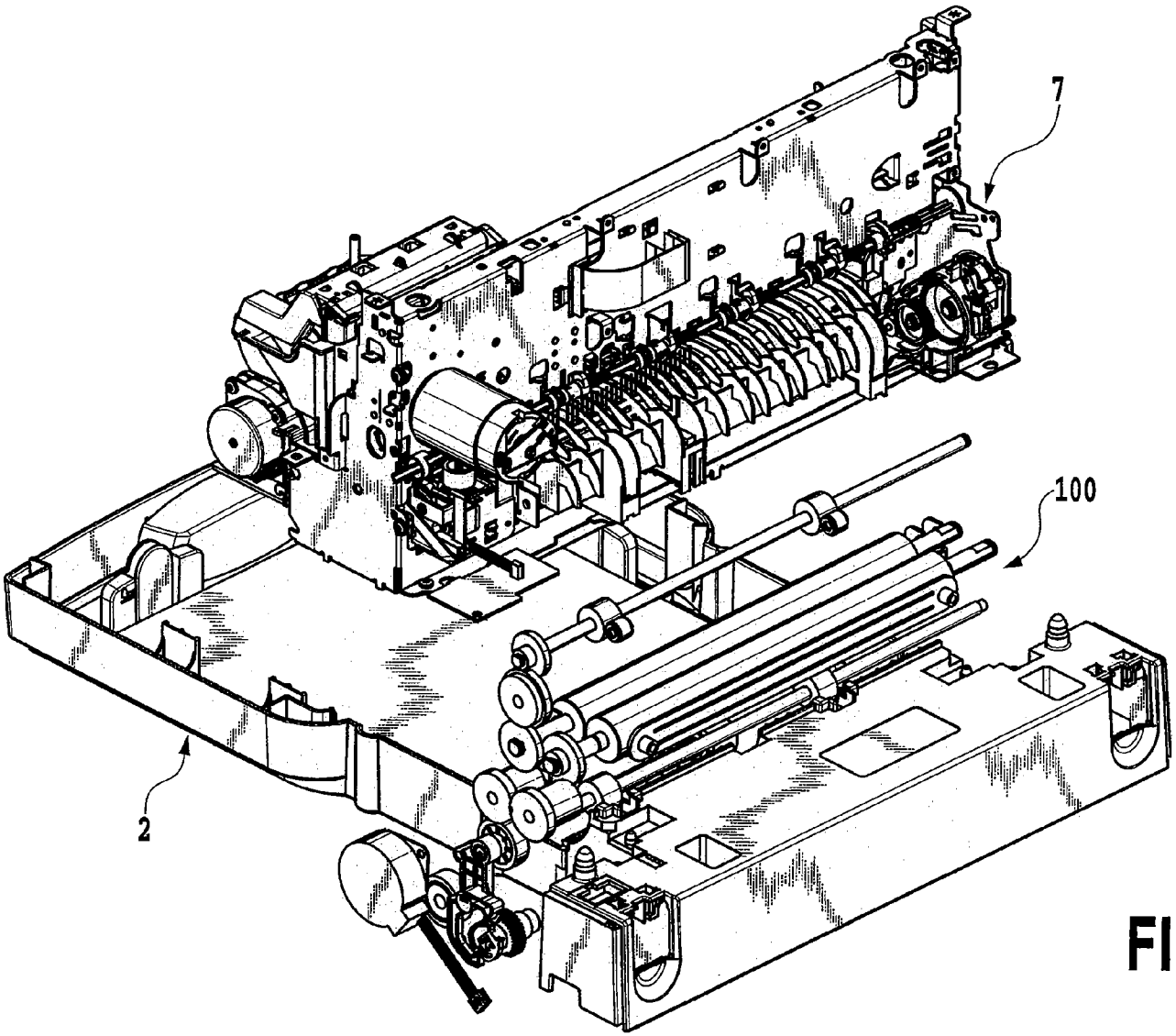
FIG. 21 is a perspective view showing an essential part of the ink jet printing apparatus shown in FIG. 20.

FIG. 21 is a perspective view showing an essential part of the above ink jet printing apparatus. As shown in the figure, an applying mechanism 100 is provided above one end of the feeding tray 2. A printing mechanism comprising the print head 7 and the like is provided above the applying mechanism 100 and above a central portion of the feeding tray 2.

Figure 22:
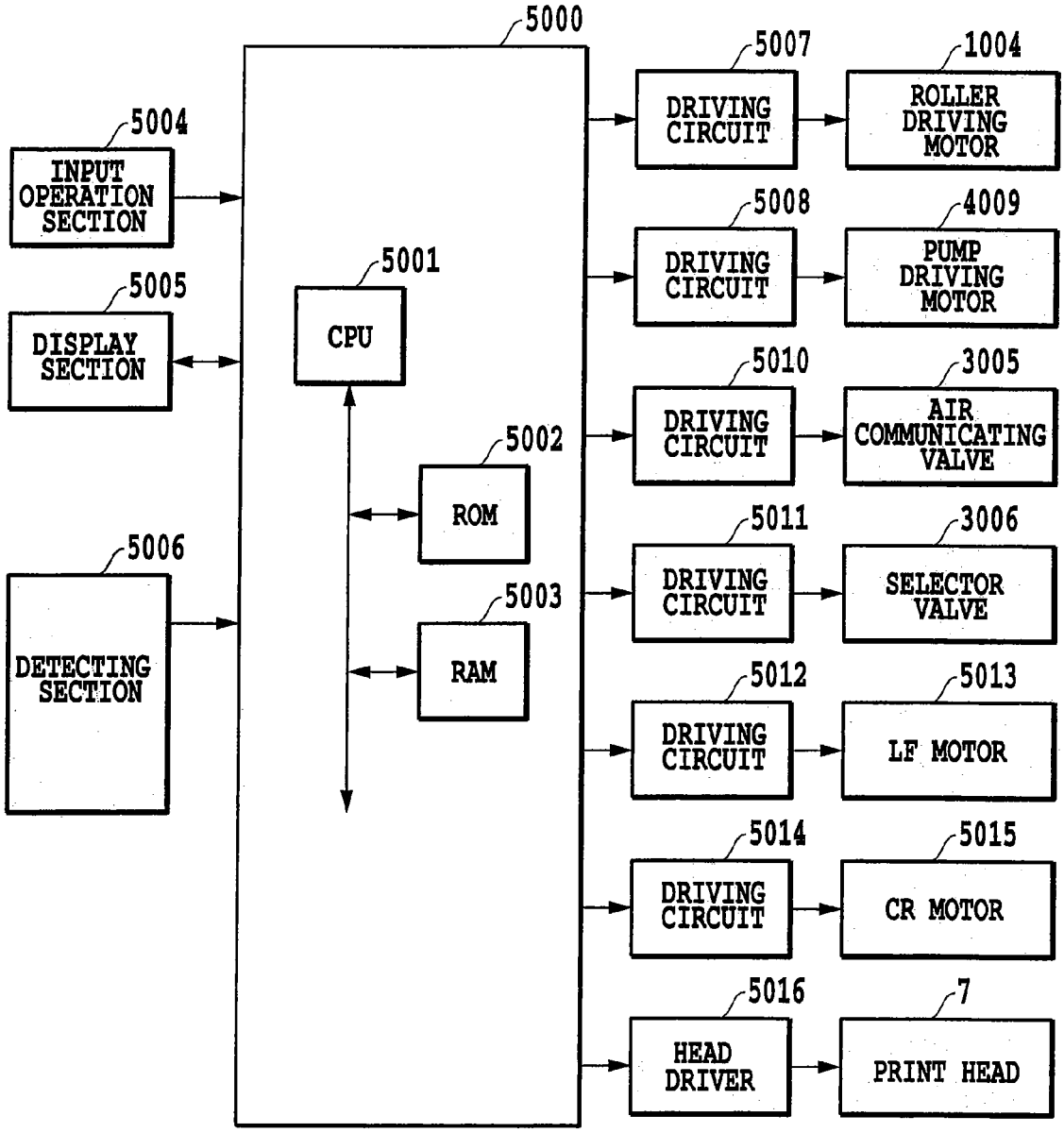
FIG. 22 is a block diagram generally showing the configuration of a control system of the ink jet printing apparatus according to the present invention.

FIG. 22 is a block diagram showing a control arrangement for the above ink jet printing apparatus. In this figure, the roller driving motor 1004, the pump driving motor 4009, and the actuator 3005 for the air communicating valve, all of which are elements of the liquid applying mechanism, are similar to those descried for the liquid applying apparatus.

In accordance with a program of a process procedure described later in FIG. 23, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That is, driving by the LF motor 5013 rotates the conveying roller 4. Driving by the CR motor moves a carriage on which the print head 7 is mounted. Moreover, the CPU 5001 performs control such that inks are ejected through the nozzles in the print head.

Figure 23:
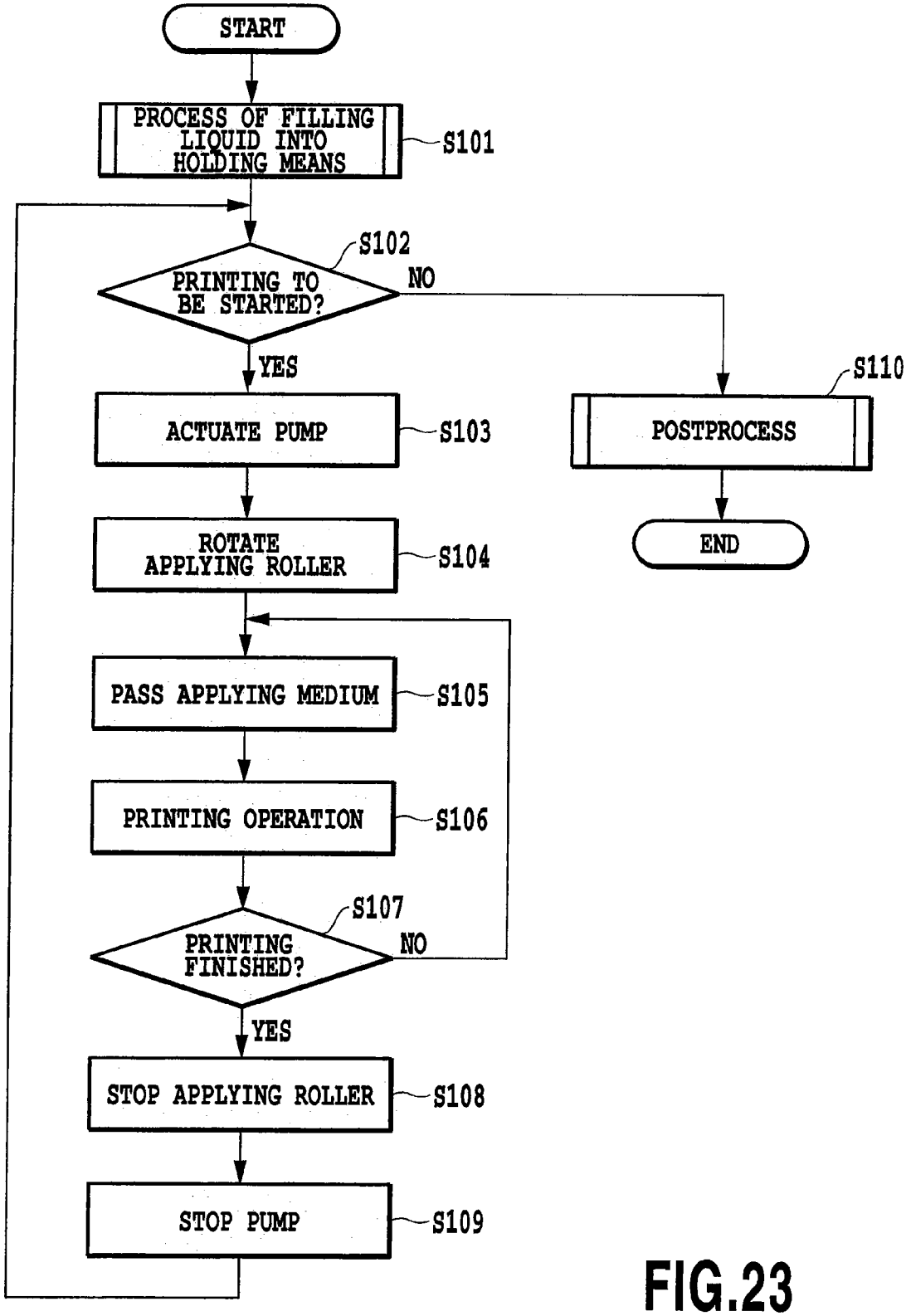
FIG. 23 is a flowchart showing the sequences of an applying operation and a printing operation according to another embodiment of the present invention.

FIG. 23 is a flowchart showing the procedure of liquid application and an accompanying printing operation in the ink jet printing apparatus according to the present embodiment. In the figure, the processing during steps S101, during S103 to S105, and during S108 to S110 is similar to that during step S1, during steps S3 to S5, and during steps S7 to S9, all the steps being shown in FIG. 13.

As shown in FIG. 23, in the present embodiment, a print start instruction is given (step S102). Then, a series of liquid applying operations such as pump activation are performed (steps S103 to S105).

After this applying step, a printing operation is performed on a print medium having the application liquid applied to desired parts of the medium (step S106). That is, the print head 7 is scanned over the print medium P conveyed by the conveying roller 4 by a predetermined amount at a time. During the scan, inks are ejected from the nozzles in accordance with print data so as to adhere to the print medium to form dots. The adhering inks react with the application liquid, thus improving the concentration and preventing bleeding. The conveyance of the print medium and the scanning of the print head are repeated to print the print medium P. The finished print medium is discharged onto the sheet discharging tray 10. When the apparatus determines in step S107 that the printing has been finished, the processing in step S108 and the subsequent steps is executed to finish the present process.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one print medium has been completely applied the application liquid to as described in Japanese Patent Application Laid-open No. 2002-096452.

In the above embodiments, by way of example, the liquid is applied in the ink jet printing-based printing apparatus. However, the present invention is applicable to printing apparatuses based on other systems. For example, the degree of whiteness of the medium can be improved by using a liquid containing a fluorescent whitening agent as an application liquid. A liquid containing components to restrain a curl (phenomenon in which a medium becomes curve shape) of the application medium may be used. The printing means after the liquid application is not limited to the ink jet printing system. Effects can be produced using a printing system such as a thermal transfer system or an electrophotographic system. In a silver salt-based printing apparatus, a photosensitive agent as the application liquid may be applied before printing.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications that fall within the true spirit of the invention.

This application claims priority from Japanese Patent Application Nos. 2004-035800 filed Feb. 12, 2004 and 2005-006773 filed Jan. 13, 2005, which are hereby incorporated by reference herein.

What is claimed is:

1. A printing apparatus comprising:

a conveying mechanism to convey a print medium along a predetermined conveying path;

a printing mechanism to perform printing on the print medium by ejecting ink to the print medium;

an applying member which applies a liquid to the print medium conveyed along the convey path, the applying member having an applying surface;

a holding member that has an abutting portion which abuts against the applying surface to form a liquid holding space in which the liquid is held, the abutting portion being annularly formed of a single member;

a supply port which is disposed near one end of the holding member in a longitudinal direction thereof, to supply the liquid to the holding member; and a collecting port which is disposed near the other end of the holding member in a longitudinal direction thereof, to collect the liquid from the holding member, wherein the printing mechanism comprises an ink jet print head that carries out printing by ejecting the ink to the print medium.

2. The printing apparatus according to claim 1, wherein the applying member comprises a single roller having an outer peripheral surface as the applying surface, and the print medium is contacted with a part of the applying surface of the roller, while the abutting portion of the holding member abuts against another part of the applying surface.

3. The printing apparatus according to claim 1, wherein the applying member comprises a plurality of rollers arranged in contact with one another and each having an outer peripheral surface as the applying surface, and the print medium is coated with the applying surface of one of the plurality of rollers which lies at one end of the plurality of rollers, while the abutting portion of the holding member abuts against the applying surface of the roller lying at the other end of the plurality of rollers.

4. The printing apparatus according to claim 1, wherein the applying member comprises an endless belt that moves circularly, and the print medium is contacted with a part of the applying surface formed on one surface of the endless belt, while the abutting portion of the holding member abuts against another part of the applying surface.

5. The printing apparatus according to claim 1, wherein the holding member controllably supplies the applying liquid to the applying surface of the applying member in layers, the applying surface of the applying member moving from the liquid holding space to an exterior.

6. The printing apparatus according to claim 1, wherein after the liquid has been applied to the print medium, the applying surface is moved to pass an amount of applying liquid remaining on the applying surface, between the abutting portion of the holding member and the applying surface to return the applying liquid to the liquid holding space.

7. The printing apparatus according to claim 1, wherein at least one of the abutting portion of the holding member and the applying surface of the applying member comprises an elastic body.

8. The printing apparatus according to claim 7, wherein the elastic body mainly comprises silicone.

9. The printing apparatus according to claim 1, wherein the applying surface of the applying member has a lower hardness than that of the abutting portion of the holding member.

10. The printing apparatus according to claim 1, wherein the abutting portion of the holding member has a smaller coefficient of friction than that of the applying surface of the applying member.

11. The printing apparatus according to claim 1, wherein the abutting portion of the holding member comprises a downstream edge and an upstream edge which extend in a direction crossing one in which the applying member rotates and a first side edge and a second side edge which extend along the rotative moving direction of the applying member, wherein the single member goes through each edge to form the annular shape.

12. The printing apparatus according to claim 11, wherein the abutting portion of the holding member is formed so that at least the first side edge and the second side edge maintain their side shape conforming to the shape of the applying surface even when the abutting portion of the holding member is separated from the applying surface of the applying member.

13. The printing apparatus according to claim 11, wherein at least one of the downstream and upstream edges of the abutting portion of the holding member, through which the applying liquid remaining on the applying surface is passed has a lateral sectional shape circularly formed along the shape of the circular applying surface of the applying member.

14. The printing apparatus according to claim 1, wherein the holding member has a space-forming base material having almost the same lengths in a direction orthogonal to the moving direction of the applying member, as the applying member; and wherein the abutting portion of the holding member projects from one surface of the space-forming base material, against the applying surface of the applying member so that the liquid holding space is formed by the space-forming base material, the abutting portion of the holding member, and the applying surface of the applying member.

15. The printing apparatus according to claim 14, wherein the space-forming base material and the abutting portion of the holding member are integrally formed of a single member.

16. The printing apparatus according to claim 1, wherein the liquid contains water and a component that relaxes a surface tension of the water.

17. The printing apparatus according to claim 1, wherein the abutting portion of the holding member comprises a downstream edge and an upstream edge which extend in a direction crossing one in which the applying member rotates, an abutting surface of the applying member located downstream in its rotative moving direction lies, in a vertical direction, below its abutting surface located upstream in its rotative moving direction, and the holding member is pressed against the applying member upward with respect to a horizontal line.

18. A printing apparatus comprising:

a conveying mechanism that conveys a print medium along a predetermined conveying path;

a printing mechanism that performs printing on the print medium by ejecting ink to the print medium;

an applying member which applies a liquid to the print medium conveyed along the convey path, the applying member having an applying surface;

a holding member that has an abutting portion which abuts against the applying surface to form a liquid holding space in which the liquid is held, the abutting portion being annularly formed of a single member;

a supply port which is disposed near one end of the holding member in a longitudinal direction thereof, to supply the liquid to the holding member; and a collecting port which is disposed near the other end of the holding member in a longitudinal direction thereof, to collect the liquid from the holding member;

wherein the holding member has a space-forming base material having almost the same length, in a direction orthogonal to the moving direction of the applying member, as the applying member; and wherein the abutting portion of the holding member projects from one surface of the space-forming base material against the applying surface of the applying member so that the liquid holding space is formed by the space-forming base material, the abutting portion of the holding member, and the applying surface of the applying member.

19. A printing apparatus comprising:

a conveying mechanism that conveys a print medium along a predetermined conveying path;

a printing mechanism that performs printing on the print medium by ejecting ink to the print medium;

an applying member which applies a liquid to the print medium conveyed along the convey path, the applying member having an applying surface;

a holding member that has an abutting portion which abuts against the applying surface to form a liquid holding space in which the liquid is held, the abutting portion being annularly formed of a single member;

a supply port which is disposed near one end of the holding member in a longitudinal direction thereof, to supply the liquid to the holding member; and a collecting port which is disposed near the other end of the holding member in a longitudinal direction thereof, to collect the liquid from the holding member, wherein the abutting portion of the holding member comprises a downstream edge and an upstream edge which extend in a direction crossing one in which the applying member rotates, an abutting surface of the applying member located downstream in its rotative moving direction lies, in a vertical direction, below its abutting surface located upstream in its rotative moving direction, and the holding member is pressed against the applying member upward with respect to a horizontal line.

* * * * *